US008074377B2

(12) United States Patent
Nishiwaki et al.

(10) Patent No.: US 8,074,377 B2
(45) Date of Patent: Dec. 13, 2011

(54) SHOE SOLE WITH REINFORCEMENT STRUCTURE

(75) Inventors: Tsuyoshi Nishiwaki, Kobe (JP); Yosuke Ootsuka, Kobe (JP); Satoshi Kiso, Kobe (JP)

(73) Assignee: Asics Corporation, Kobe (JP)

( * ) Notice: Subject to any disclaimer, the term of this patent is extended or adjusted under 35 U.S.C. 154(b) by 947 days.

(21) Appl. No.: 11/991,759

(22) PCT Filed: Oct. 11, 2006

(86) PCT No.: PCT/JP2006/320273

§ 371 (c)(1),
(2), (4) Date: Mar. 10, 2008

(87) PCT Pub. No.: WO2007/046277

PCT Pub. Date: Apr. 26, 2007

(65) Prior Publication Data

US 2010/0218397 A1 Sep. 2, 2010

(30) Foreign Application Priority Data

Oct. 20, 2005 (JP) ..... 2005-305378

(51) Int. Cl.
*A43B 13/00* (2006.01)

(52) U.S. Cl. ..... 36/25 R; 36/28; 36/88; 36/91

(58) Field of Classification Search ..... 36/25 R, 36/88, 91, 30 R, 7.8, 72 A, 76 R, 73, 27–29
See application file for complete search history.

(56) References Cited

U.S. PATENT DOCUMENTS

| | | | | |
|---|---|---|---|---|
| 2,275,720 | A * | 3/1942 | Bingham, Jr. | 36/30 R |
| 3,667,473 | A | 6/1972 | Matteson | |
| 3,841,005 | A | 10/1974 | Cox | |
| 5,528,842 | A * | 6/1996 | Ricci et al. | 36/27 |
| 5,577,334 | A * | 11/1996 | Park | 36/28 |
| 5,794,359 | A * | 8/1998 | Jenkins et al. | 36/28 |

(Continued)

FOREIGN PATENT DOCUMENTS

JP 50-27425 9/1975

(Continued)

OTHER PUBLICATIONS

International Search Report of the International Searching Authority mailed Jan. 16, 2007, issued in connection with International Patent Appln. No. PCT/JP2006/320273 (3 pages).

*Primary Examiner* — Marie Patterson
(74) *Attorney, Agent, or Firm* — Mintz, Levin, Cohn, Ferris, Glovsky and Popeo, P.C.

(57) ABSTRACT

A shoe sole of the present invention includes a first member 10 including a first deformable portion 11, and a second member 20 including a second deformable portion 21. In a non-worn state, a first lower surface 10*d* of the first deformable portion 11 and a second upper surface 20*u* of the second deformable portion 21 are substantially spaced apart from each other in a vertical direction. Under a first load, the first deformable portion 11 deflects downward, whereby the first lower surface 10*d* can approach the second upper surface 20*u* until the first lower surface 10*d* contacts the second upper surface 20*u*. Under a second load, the deformable portions 11 and 21 both deflect downward with the engagement elements 12 and 22 of the deformable portions 11 and 21 engaging with each other.

6 Claims, 20 Drawing Sheets

U.S. PATENT DOCUMENTS

| | | | | |
|---|---|---|---|---|
| 5,893,219 | A * | 4/1999 | Smith et al. | 36/3 B |
| 6,338,206 | B1 * | 1/2002 | Kita | 36/29 |
| 6,516,539 | B2 * | 2/2003 | Nishiwaki et al. | 36/28 |
| 6,625,905 | B2 * | 9/2003 | Kita | 36/30 R |
| 6,647,645 | B2 * | 11/2003 | Kita | 36/28 |
| 6,782,641 | B2 * | 8/2004 | Turner et al. | 36/29 |
| 6,968,637 | B1 * | 11/2005 | Johnson | 36/88 |
| 7,100,308 | B2 * | 9/2006 | Aveni | 36/27 |
| 7,162,815 | B2 * | 1/2007 | Miyauchi et al. | 36/103 |
| 2002/0144430 | A1 * | 10/2002 | Schmid | 36/27 |
| 2003/0005600 | A1 * | 1/2003 | Kita | 36/76 R |
| 2006/0137228 | A1 * | 6/2006 | Kubo et al. | 36/103 |

FOREIGN PATENT DOCUMENTS

| | | | |
|---|---|---|---|
| JP | 2003-019004 | | 1/2003 |
| WO | WO2005/037002 | A1 | 4/2005 |

* cited by examiner

SHOE SOLE WITH REINFORCEMENT STRUCTURE

TECHNICAL FIELD

The present invention relates to a shoe sole with a reinforcement structure including a so-called "shank" (a reinforcement member).

BACKGROUND ART

Shoe soles in which a reinforcement member that is matched to the shape of the arch of the mid sole is provided in the arch portion of the shoe soles are known in the prior art, e.g., shoe soles in which a portion of the mid sole that is not attached to the outer sole does not come into contact with the ground upon landing of the outer sole. Such a reinforcement structure suppresses the deformation of the mid sole, thereby reinforcing the rigidity of the arch portion of the mid sole. Examples of such known structures (the first and second patent documents) are shown in FIGS. 15A and 15B.

First Patent Document: Japanese Laid-Open Patent Publication No. 2003-19004 (FIG. 5)

Second Patent Document: WO2005/037002A1 (Abstract)

FIG. 15A is a side view of a shoe sole disclosed in Japanese Laid-Open Patent Publication No. 2003-19004 (FIG. 5) (laid open on Jan. 21, 2003). In the shoe sole, an arch 102 is formed in a bottom portion of the arch portion of a mid sole 101. A first reinforcement member 103 is attached to the lower surface of the arch 102, and a second reinforcement member 104 is provided below the first reinforcement member 103.

When a load is applied on the shoe sole of FIG. 15A, the wearer will feel an upthrust on the arch of the foot.

FIG. 15B is a cross-sectional view showing a shoe sole disclosed in WO2005/037002 A1 (laid open on Apr. 28, 2005). Referring to this figure, a hole 203 is provided in the lower surface of a first arch 201, and a protrusion 204 that can fit in the hole 203 is provided on the upper surface of a second arch 202.

These pieces of prior art disclose providing a plurality of members vertically spaced apart from each other in the middle foot portion of the shoe sole, in view of the bending or twisting load to be applied to the middle foot portion of the foot.

DISCLOSURE OF THE INVENTION

However, they fail to disclose a structure in which the vertically-spaced members cooperate with each other so that the rigidity against the bending or twisting is significantly varied as necessary.

The load applied to a foot in a stationary position, or the like, is a steady load that is smaller than the tolerance limit of a joint, or the like. Excessively protecting a foot against such a steady load will result in the wearer feeling an upthrust on the arch or will inhibit the free movement of the foot. On the other hand, a foot may sometimes receive an excessive load, which can impart a substantial burden to the foot, and it is important to protect the foot from such an excessive load.

An object of the present invention is to provide a shoe sole such that an upthrust is less likely to be felt on the arch and the free movement of the foot is less likely to be inhibited when a steady load is applied to the arch of the foot, and such that when an excessive load is applied to the arch of the foot, a great rigidity is exerted to enhance the function of protecting the arch of the foot.

A shoe sole of the present invention has a front foot portion, a middle foot portion and a rear foot portion, and includes: a first member covering at least a portion of an arch of a foot; and a second member placed under the first member.

In the shoe sole of the present invention: the first member and the second member are attached to each other in a first attachment section at a rear end of the front foot portion; the first member and the second member are attached to each other in a second attachment section at a front end of the rear foot portion; the first member includes a first deformable portion capable of bending deformation, formed between the first attachment section and the second attachment section; the second member includes a second deformable portion capable of bending deformation, formed between the first attachment section and the second attachment section; the first deformable portion includes a first upper surface and a first lower surface; the second deformable portion includes a second upper surface and a second lower surface; and the first lower surface is facing the second upper surface.

In a non-worn state where a shoe is not put on a foot, the first lower surface and the second upper surface are substantially spaced apart from each other in a vertical direction. In a worn state where the shoe is put on a foot and where a first load smaller than a predetermined load is downwardly applied to the first upper surface, the first deformable portion deflects downward, whereby the first lower surface can approach the second upper surface until the first lower surface contacts the second upper surface.

Thus, in the non-worn state, the first lower surface and the second lower surface are spaced apart from each other, whereby the first member can deflect to a relatively large extent in the initial portion of the period under the first load. Therefore, an upthrusting feel is less likely to occur on the sole of the foot.

In the latter or end portion of the period under the first load, the arch of the foot is supported by the first deformable portion, which is deflecting downward to a large extent, and the second deformable portion, which is deformed to a small extent. Also in this case, since the reaction force from the second deformable portion is small, the upthrusting feel on the arch of the foot is reduced. Moreover, the combined flexural rigidity $E \cdot I_Z$ of the first and second members increases from that in the initial portion of the period under the first load as these members contact with each other and together form a layered beam.

The first and second members being "attached to each other" in the first attachment section and in the second attachment section means that these members are attached together so that they do not shift from each other in the longitudinal direction in the first attachment section and in the second attachment section. This refers not only to a case where these members are directly attached to each other, but also to a case where they are indirectly attached to each other via another member therebetween.

The first lower surface and the second upper surface "being substantially spaced apart from each other in vertical direction" means that there is no an engaging force between the first lower surface and the second upper surface, preventing the shifting therebetween in the longitudinal direction. This refers not only to a case where these surfaces are not at all in contact with each other, but also to a case where they are in contact with each other to such a degree that there is substantially no engaging force.

In a preferred embodiment of the present invention, the first deformable portion is provided with a plurality of first engagement elements that are spaced apart from one another at least in a longitudinal direction, the second deformable portion is provided with a plurality of second engagement elements that are spaced apart from one another at least in the longitudinal direction.

Herein, "being spaced apart from each other at least in the longitudinal direction" refers to a case where the plurality of engagement elements are spaced apart from one another both in the longitudinal direction and in the transverse direction, and refers to a case where they are spaced apart from one another in the longitudinal direction even to a small degree.

In this embodiment, in a worn state where the shoe is put on a foot and where a second load greater than the predetermined load is downwardly applied to the first upper surface, a portion of the first deformable portion and a portion of the second deformable portion deflect downward, (1) with the first engagement elements and the second engagement elements engaging with each other in the longitudinal direction, whereby the shifting of the first lower surface and the second upper surface from each other in the longitudinal direction is suppressed or there is substantially no shifting of the first lower surface and the second upper surface from each other in the longitudinal direction, and (2) with the first lower surface being in contact with the second upper surface and a portion of the second load being applied to the second upper surface via the first lower surface. Therefore, at least a portion of the first deformable portion and at least a portion of the second deformable portion deflect downward generally integrally.

In this embodiment, under the second load, the two deformable portions deflect generally integrally, with the first lower surface and the second upper surface not substantially shifting from each other. In this case, the deformable portions serve as a combined beam, thereby significantly increasing the flexural rigidity. As a result, even if an excessive load is applied to the foot, the lowering of the arch of the foot can be prevented.

The term "the shifting in the longitudinal direction is suppressed or there is substantially no shifting in the longitudinal direction" as used herein refers not only to a case where there is little or no shifting in the longitudinal direction, but also to a case where the shifting is significantly smaller than that which would occur without the engagement elements.

Herein, "at least a portion of the first deformable portion and at least a portion of the second deformable portion deflecting downward generally integrally" means that the value obtained by differentiating the deflection of the lower surface of the first deformable portion with respect to time (the amount of deflection per unit time or per unit load) is generally the same as that of the upper surface of the second deformable portion.

In this embodiment, during a transitional period in which a load applied to the first upper surface increases from the first load to the second load, the first deformable portion and the second deformable portion may deflect downward with the first lower surface and the second upper surface being in contact with each other and substantially shifting from each other in the longitudinal direction.

While the shift in the transitional period is greater than that under the second load, this amount of shift typically decreases as the load increases. Therefore, the flexural rigidity in the transitional period gradually increases as the load increases and minute amounts of time elapse. As a result, a rapid increase in the reaction force from the deformable portions is unlikely to occur, and an upthrust is unlikely to be felt on the arch of the foot.

In this embodiment, typically, the area of engagement across which the engagement elements engage with each other increases (e.g., the area of contact across which the engagement elements contact with each other) as the load applied to the first upper surface increases. Moreover, as the load applied to the first upper surface increases, the engaging force in the longitudinal direction by which the engagement elements engage with each other increases (the force which suppresses the shifting between the deformable portions in the longitudinal direction increases), due to the increase in the area of engagement.

The length of the transitional period, which is dictated by the Young's modulus of the materials of the engagement elements and the first and second deformable portions, is typically a minute amount of time ΔT. Herein, "substantially shifting from each other in the longitudinal direction" means that the first lower surface and the second upper surface are in contact with each other, thus exerting some engaging force, but there still is minute shifting therebetween.

In another preferred embodiment of the present invention: the first deformable portion includes a first medial portion located on a medial side of the foot and a first lateral portion located on a lateral side of the foot; the second deformable portion includes a second medial portion located on the medial side of the foot and a second lateral portion located on the lateral side of the foot; and in the non-worn state (in the absence of an applied load), the first medial portion and the second medial portion are not attached to each other, and the first lateral portion and the second lateral portion are not attached to each other.

Specifically, a space running through from the medial side to the lateral side of the foot is formed between the first deformable portion of the first member and the second deformable portion of the second member. Therefore, under the first load, the first member can deform in bending deformation, or the like, without being restricted by the second member.

In still another preferred embodiment of the present invention, the first lower surface does not contact the second upper surface when the shoe is put on the foot by a person who weighs 50 kg to 70 kg and who is standing still.

The first lower surface does not contact the second upper surface when standing still, and the first lower surface contacts the second upper surface when the load applied to the first upper surface increases when in motion. This suppresses the upthrusting feel on the arch of the foot, and suppresses a substantial drop of the arch of the foot. The stand-still position herein refers to a position where the person is standing still with the load being equally distributed between the feet.

Dynamic Principle Being Basis of Present Invention:

Referring to FIG. 1, a dynamic principle being the basis of the present invention will now be described.

In (a) of FIG. 1, a first beam 111 and a second beam 112, vertically laid on each other, are simply supported. The beams 111 and 112 are not bonded together, and are in the form of a layered beam 110. In this state, when the load W is applied to the layered beam 110, the two beams 111 and 112 deflect while shifting from each other in the longitudinal direction at an interface 113 therebetween, as shown in (b) of FIG. 1. In this case, assuming that the flexural rigidity of one beam 111 (112) is $E \cdot I_Z$, the flexural rigidity $E \cdot I_2$ of the layered beam 110 is about twice E dz.

Referring to (c) of FIG. 1, a first beam 121 and a second beam 122 together form a combined beam 120 as if they were bonded together so that they would not shift or come apart from each other at an interface 123 therebetween. In this state, when the load W is applied to the combined beam 120, the two beams 111 and 112 deflect without shifting from each other in the longitudinal direction at the interface 123, as shown in (d) of FIG. 1. In this case, assuming that the flexural rigidity of one beam 121 (122) is $E \cdot I_Z$, the flexural rigidity $E \cdot I_8$ of the combined beam 120 is about eight times $E \cdot I_Z$.

Specifically, for a beam having a rectangular cross section, the flexural rigidity of the beam is given by Expression (0) below:

$$\text{Flexural rigidity} = E \cdot I_Z \quad (0)$$

wherein E is the Young's modulus of the material, and $I_z$ is the moment of inertia of area, which is given by Expression (1) below:

$$I_Z = b \cdot h^3/12 \quad (1)$$

where b is the width of the beam in the cross section, and h is the height of the beam in the cross section.

Thus, whether or not the upper and lower beams shift from each other in the beam axis direction (the longitudinal direction) at the interfaces 113 and 123 significantly influences the magnitude of the flexural rigidity $E \cdot I_Z$.

Referring to (e) of FIG. 1, a first beam 10 and a second beam 20, in their first and second deformable portions 11 and 21, are vertically spaced apart from each other in the absence of applied load. When the load W is applied, the lower surface (the contact surface) of the first beam 10 comes close to, and then contacts, the upper surface (the contact surface) of the second beam 20. During the period up until the contact, the two beams 10 and 20 do not function as a combined beam. As the load W increases, the structure goes through a transitional period ΔT ((f) of FIG. 1) in which the contact surfaces having engagement elements thereon are slightly shifted from each other in the longitudinal direction, and then reach a state where the structure is close to being a combined beam ((g) of FIG. 1) in which the beams are not substantially shifted from each other in the longitudinal direction.

As shown in (h) of FIG. 1, the combined beam 120 shown in (c) of FIG. 1 exerts the flexural rigidity $E \cdot I_8$, which is greater than that of the layered beam 110 shown in (a) of FIG. 1. However, if the arch of the foot is constantly supported by the great flexural rigidity $E \cdot I_8$, there will be an upthrusting feel on the sole of the foot when walking.

In contrast, the beam structure shown in (e) of FIG. 1 does not function as a combined beam, hence a smaller flexural rigidity $E \cdot I_X$ as shown in (h) of FIG. 1, during the initial period when the load W is small, e.g., when walking. Therefore, an upthrust is less likely to be felt on the arch of the foot. As the load increases, the structure goes through the transitional period ΔT to thereafter reach a state where the structure is close to being a combined beam, upon which the flexural rigidity $E \cdot I_X$ increases significantly. Therefore, when an excessive load W is applied to the foot, the rigidity increases, and the deflection δ of the beams decreases. As a result, the function of preventing the lowering (drop) of the arch of the foot, etc., is significantly enhanced.

In (e) of FIG. 1, both of the beams 10 and 20 are provided with engagement elements. Even without such engagement elements, as long as the structure is such that the first beam 10 comes into contact with the second beam 20 as the load W is applied to the first beam 10, the beams 10 and 20 can at least exert the flexural rigidity $E \cdot I_2$ of a layered beam (about twice $E \cdot I_Z$ set forth above), the structure can serve to suppress the lowering of the arch to some extent.

While the above description is directed to the flexural rigidity for plantarflexion of the foot, it is believed that a similar phenomenon to that with the flexural rigidity as described above will occur also with the twist rigidity when the foot is twisted.

DESCRIPTION OF THE REFERENCE NUMERALS

Figure 1:
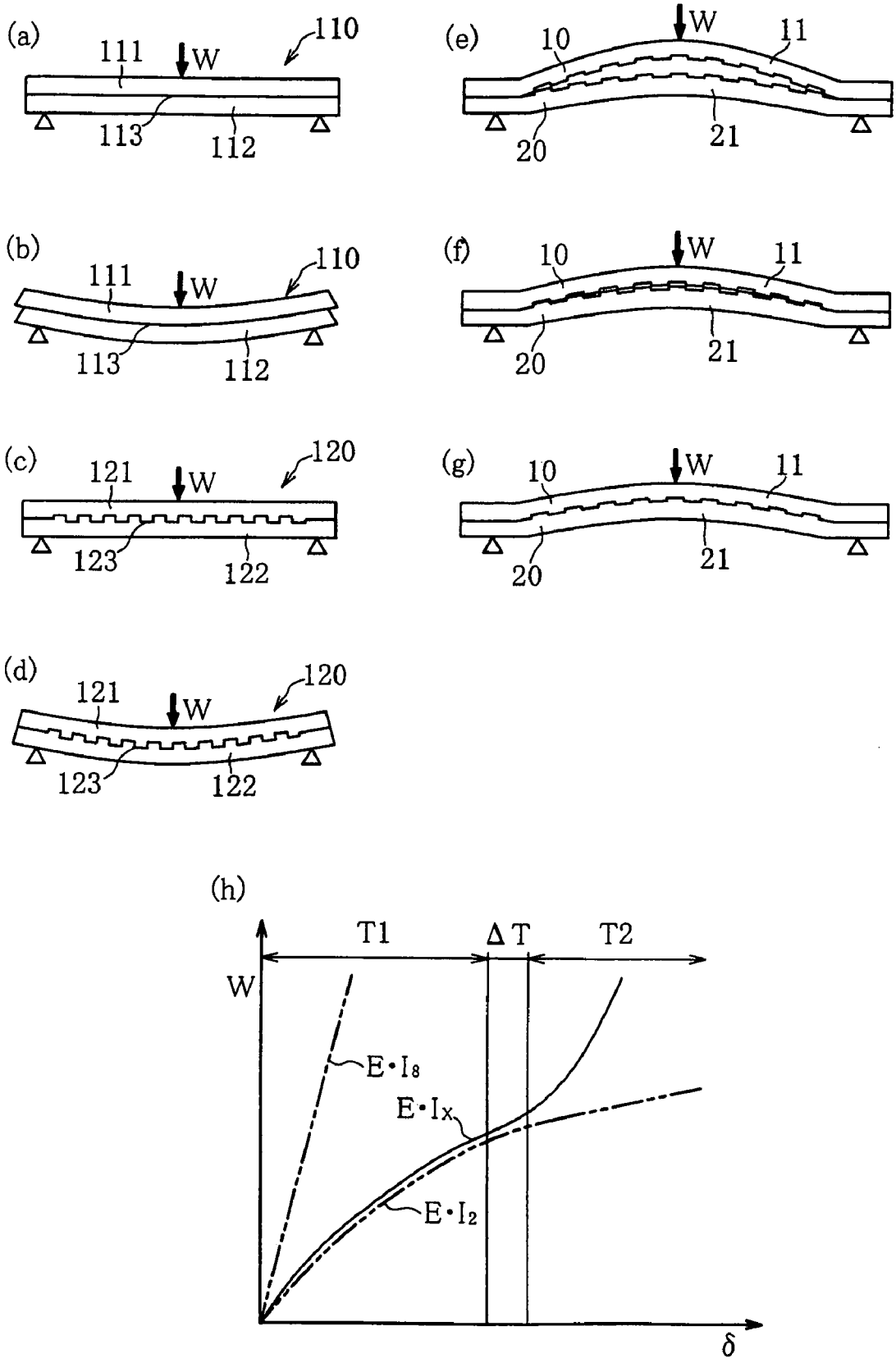
FIG. 1 shows conceptual side views (a)-(g) showing the dynamic principle being the basis of the present invention, and a graph (h) showing the transition of the flexural rigidity.

1: Outer sole
1*a*: Middle foot portion
1*b*: Rear foot portion
1*c*: Rear end of front foot portion
1*f*: Front foot portion
1*h*: Front end of rear foot portion
2,2A: Shock absorbing layers
10: First member
10*d*: First lower surface
10*u*: First upper surface
11: First deformable portion
12: First engagement element
13: Medial portion
14: Lateral portion
15: Film
20: Second member
20*d*: Second lower surface
20*u*: Second upper surface
21: Second deformable portion
22: Second engagement element
23: Medial portion
24: Lateral portion
31: First attachment section
32: Second attachment section
D1,D2: Spaces
L: Longitudinal direction
IN: Medial side
OUT: Lateral side

BEST MODE FOR CARRYING OUT THE INVENTION

The present invention will be understood more clearly from the following description of preferred embodiments taken in conjunction with the accompanying drawings. Note however that the embodiments and the drawings are merely illustrative, and the scope of the present invention shall be defined by the claims. In the accompanying drawings, like reference numerals denote like components throughout the plurality of figures.

First Embodiment

A first embodiment of the present invention will now be described with reference to FIGS. 2A to 6C. In this and subsequent figures, the arrow F denotes the front direction of the shoe, and the arrow B denotes the rear direction of the shoe.

Figure 2A:
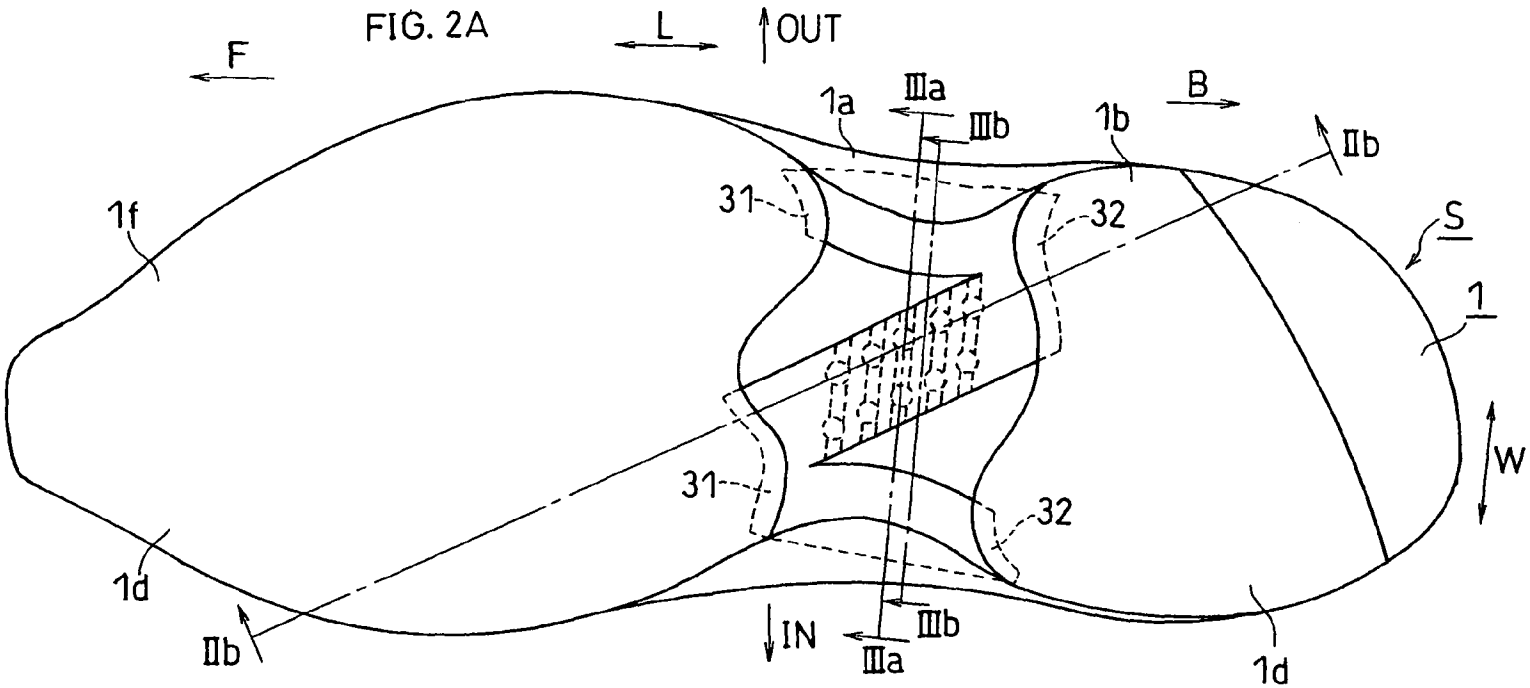
FIG. 2A is a bottom view showing a shoe sole according to a first embodiment of the present invention.
Figure 2B:
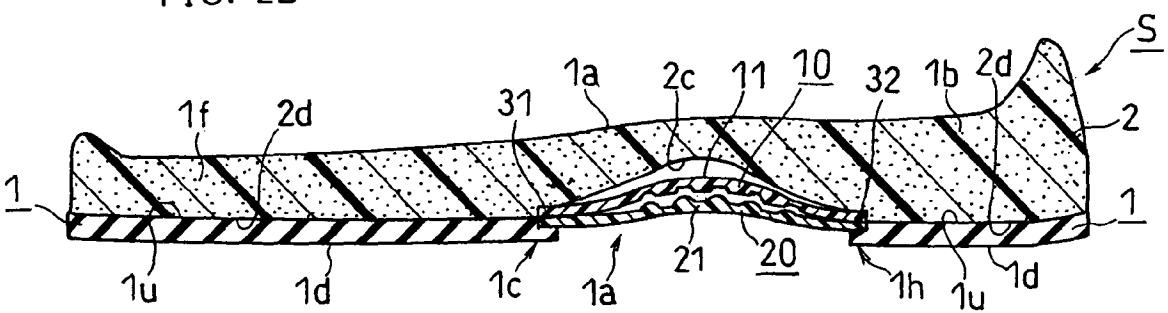
FIG. 2B is a cross-sectional view taken along line IIb-IIb in FIG. 2A.

General Structure of Shoe Sole:

FIGS. 2A and 2B show a shoe sole S being in a non-worn state where the shoe is not put on a foot.

As shown in FIGS. 2A and 2B, the shoe sole S includes an outer sole 1, a mid sole (the shock absorbing layer) 2, and first and second reinforcement members (an example of the first and second members) 10 and 20 for reinforcing a middle foot portion 1*a* of the mid sole 2.

As shown in FIG. 2A, the outer sole 1 is divided into a front foot portion 1*f* and a rear foot portion 1*b*, and the portions 1*f* and 1*b* are spaced apart from each other at the position of a middle foot portion 1*a* directly under the arch of the foot. The portions 1*f* and 1*b* of the outer sole 1 each have a ground contact surface 1*d* to be in contact with the ground upon landing, and an upper surface 1*u* (FIG. 2B) opposing the ground contact surface 1*d*.

A lower surface 2*d* of the mid sole 2 is bonded to the upper surface 1*u* of the outer sole 1. On the lower surface 2*d* of the mid sole 2, an arch portion 2*c* is formed at the position of the middle foot portion 1*a* directly under the arch of the foot. The arch portion 2*c* is formed by cutting out the lower surface 2*d* of the mid sole 2 in an arch shape, whereby the lower surface of the arch portion 2*c* is indented.

The mid sole 2 is a member for absorbing the impact upon landing, and is formed by using a foamed resin such as EVA (ethylene-vinyl acetate copolymer).

The first and second reinforcement members 10 and 20 each have a generally N-letter shape as seen in a plan view, and are formed by using a non-foamed resin plate. The reinforcement members 10 and 20 can be formed by using, for example, a material of the reinforcement member of WO2005/037002 (US2006/0137228 A1) (the entire contents of which are hereby incorporated by reference).

The first and second reinforcement members 10 and 20 are provided under the arch portion 2*c* of the middle foot portion 1*a*. The first and second reinforcement members 10 and 20 maintain the strength of the shoe sole S at the position corresponding to the arch portion 2*c*, and suppresses the bending, twisting, etc., of the shoe sole S. Therefore, the Young's modulus of the first and second reinforcement members 10 and 20 are set to values that are greater than that of the arch portion 2*c* of the mid sole 2. The Young's modulus of the first reinforcement member 10 may be set to a value smaller than that of the second reinforcement member 20.

Figure 3B:
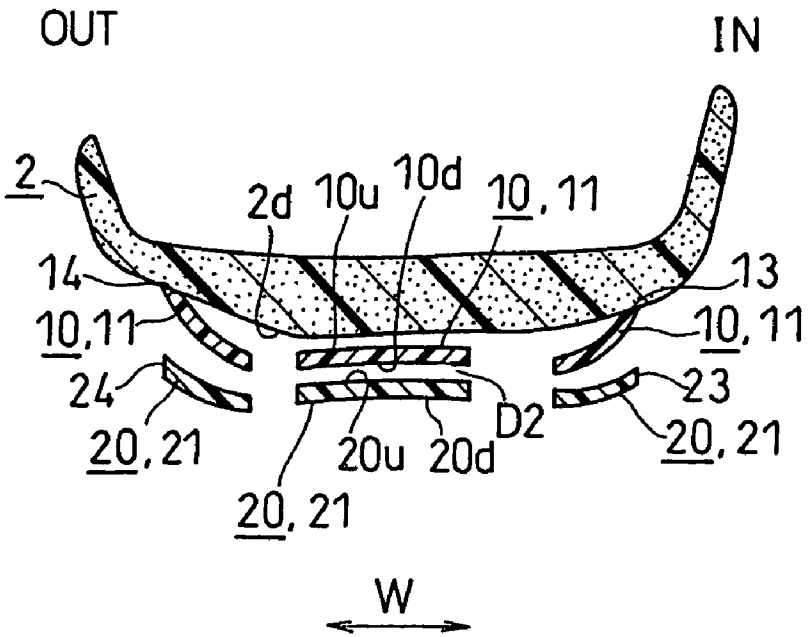
FIG. 3B is an end view taken along line IIIb-IIIb in FIG. 2A.
Figure 3A:
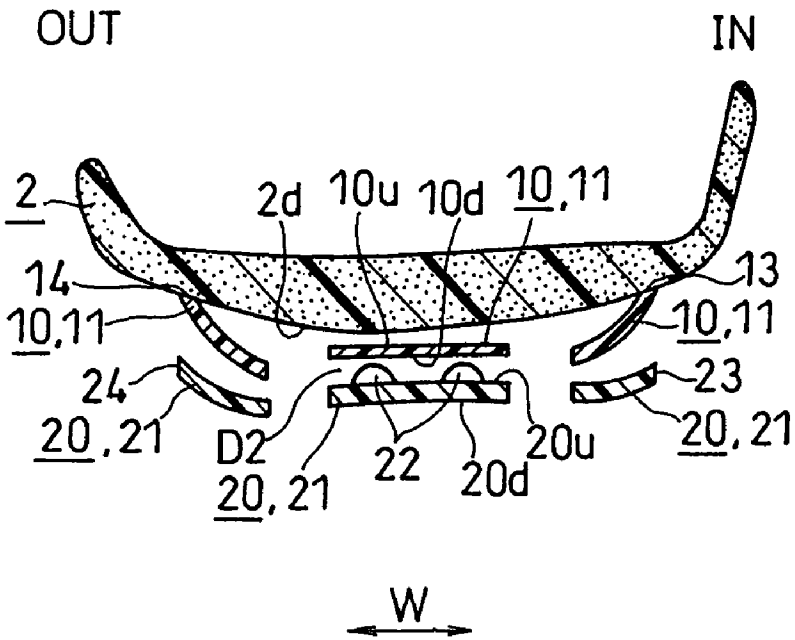
FIG. 3A is an end view taken along line IIIa-IIIa in FIG. 2A.

First and Second Reinforcement Members 10 and 20:

As shown in FIGS. 3A and 3B, the first and second reinforcement members 10 and 20 are placed under a middle foot portion 2*a* of the mid sole 2. The second reinforcement member 20 is placed generally directly under the first reinforcement member 10.

Figure 6A:
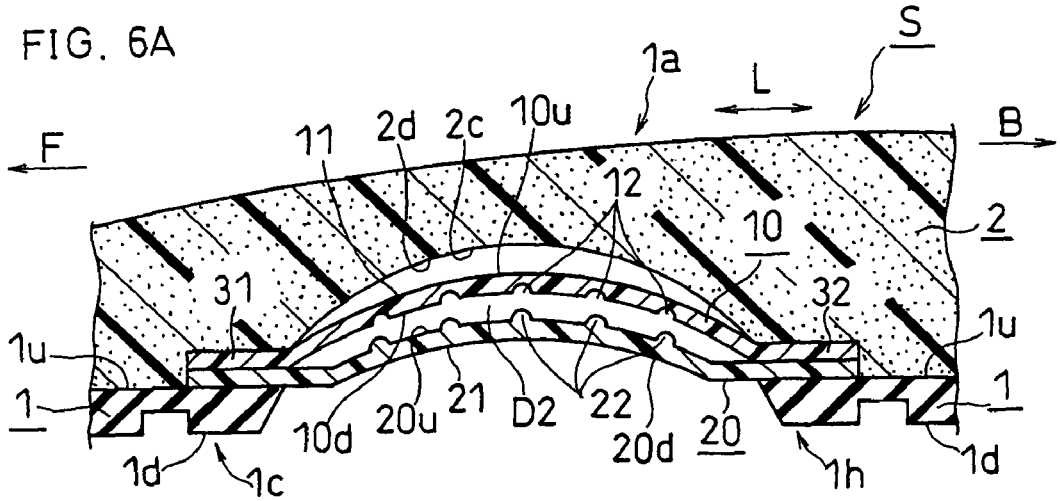
FIGS. 6A, 6B and 6C are enlarged partial vertical cross-sectional views showing a first and second member of the shoe sole of FIG. 2B and the vicinity thereof.

As shown in FIG. 6A (non-worn state), the first reinforcement member 10 and the second reinforcement member 20 are bonded or welded to each other in a first attachment section 31 at a rear end 1*c* of the front foot portion. The first reinforcement member 10 and the second reinforcement member 20 are bonded or welded to each other in a second attachment section 32 at a front end 1*h* of the rear foot portion.

In the first attachment section 31 and the second attachment section 32, the first and second reinforcement members 10 and 20 are sandwiched between the outer sole 1 and the mid sole 2, and therefore the first and second reinforcement members 10 and 20 are supported by the outer sole 1 and the mid sole 2.

The first reinforcement member 10 includes a first deformable portion 11 capable of bending deformation, formed between the first attachment section 31 and the second attachment section 32. The second reinforcement member 20 includes a second deformable portion 21 capable of bending deformation, formed between the first attachment section 31 and the second attachment section 32. The first and second deformable portions 11 and 21 are bent in an arch shape so as to bulge toward the arch portion 2*c*. In the non-worn state shown in FIG. 6A, the first deformable portion 11 of the first reinforcement member 10 is downwardly spaced apart from the mid sole 2.

The first deformable portion 11 of the first reinforcement member 10 includes a first upper surface 10*u* and a first lower surface 10*d*. The second deformable portion 21 of the second reinforcement member 20 includes a second upper surface 20*u* and a second lower surface 20*d*. The first lower surface 10*d* is facing the second upper surface 20*u*. The lower surface 2*d* of the mid sole 2 is facing the first upper surface 10*u*.

Figure 4:
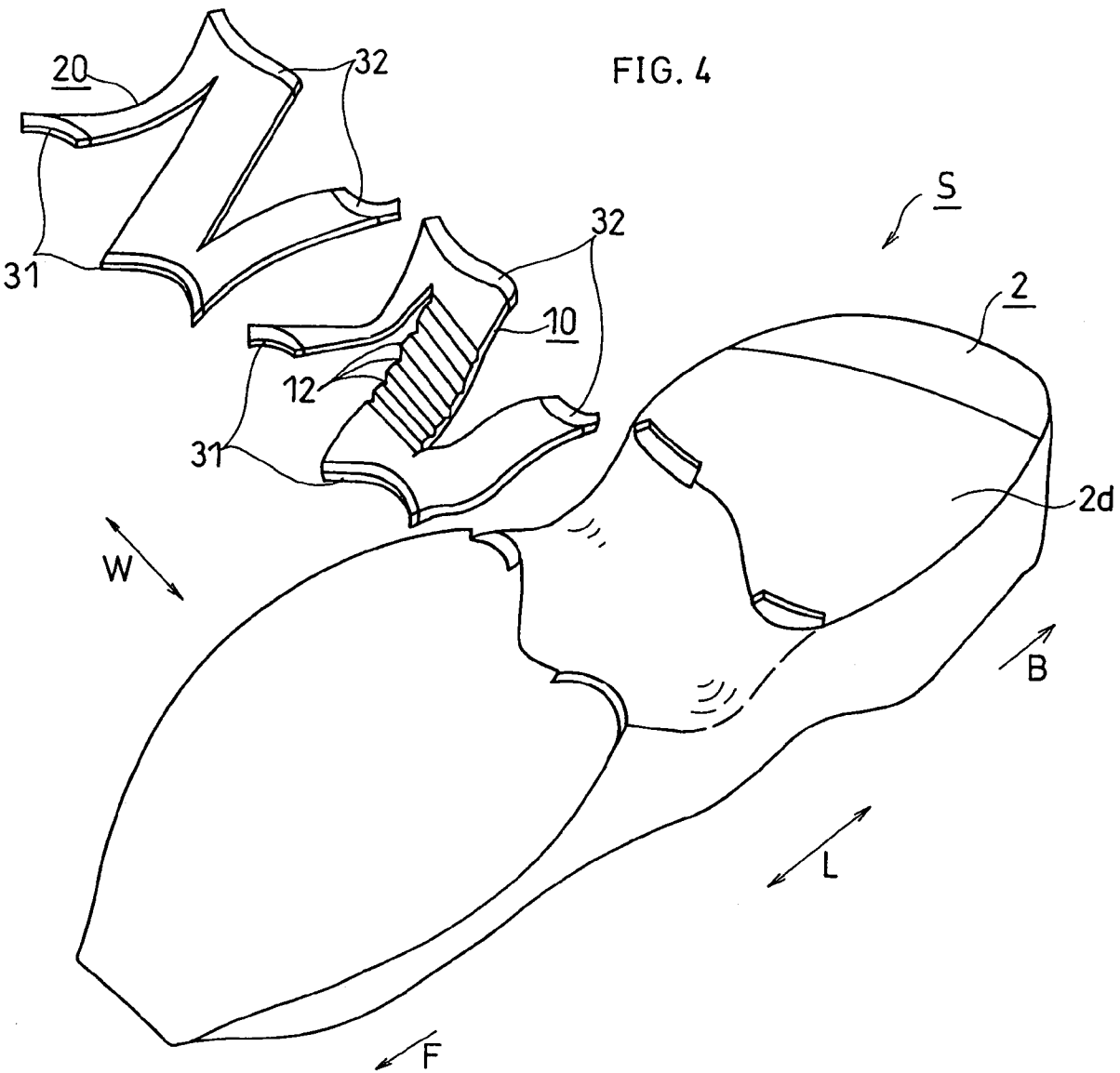
FIG. 4 is an exploded perspective view showing a reinforcement member and a mid sole, as viewed from the bottom surface side of the shoe sole.

As shown in FIG. 6A, in the first reinforcement member 10, a plurality of first engagement elements 12 spaced apart from one another in the longitudinal direction L are formed on the first lower surface 10*d*. As shown in FIG. 4, the first engagement elements 12 are a plurality of grooves (an example of the holes) being upwardly-cut indentations, and each groove extends in the transverse direction W.

Figure 5:
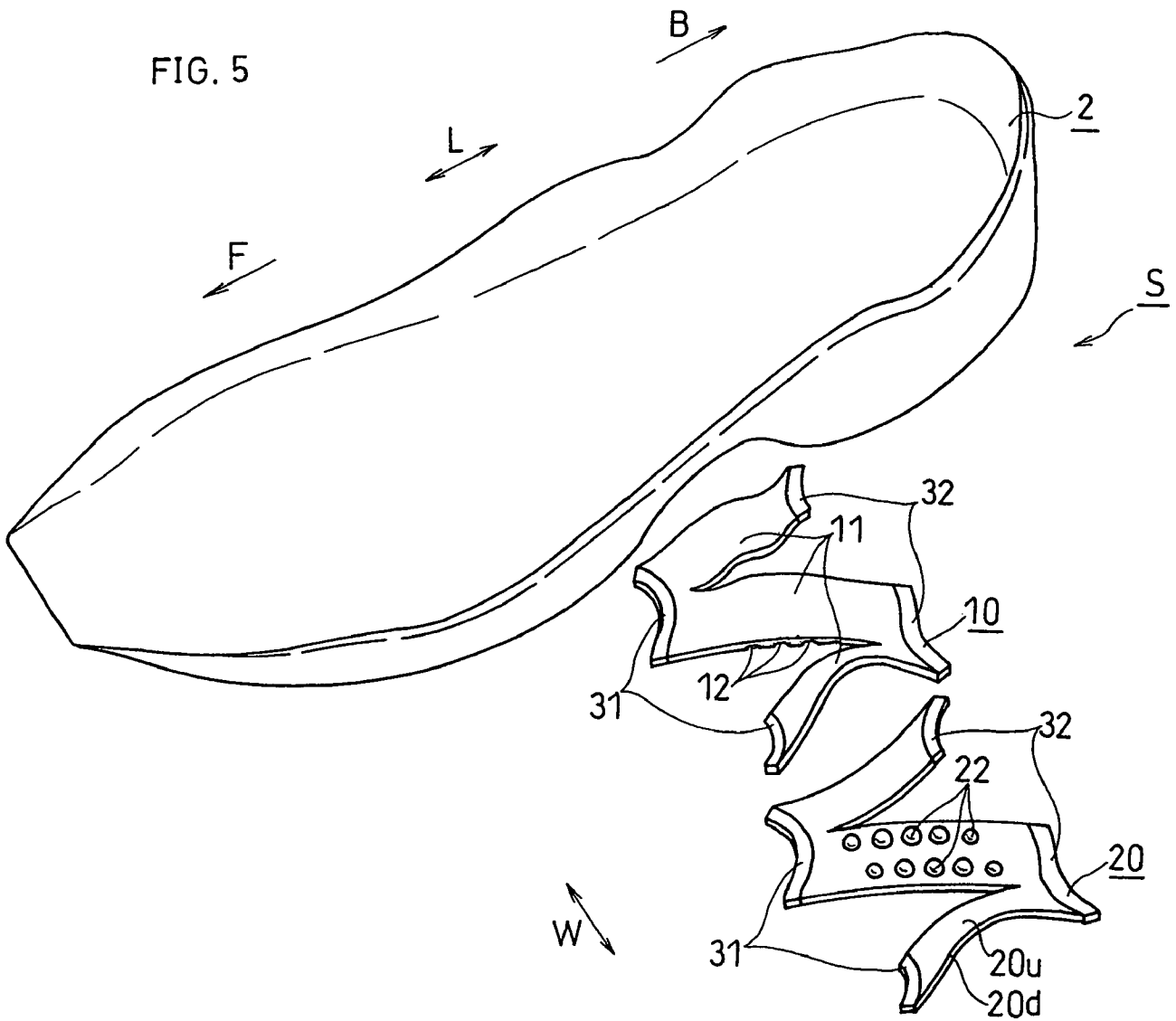
FIG. 5 is an exploded perspective view showing a reinforcement member and a mid sole, as viewed from the upper surface side of the shoe sole.

As shown in FIG. 6A, in the second reinforcement member 20, a plurality of second engagement elements 22 spaced apart from one another in the longitudinal direction L and in the transverse direction W are formed on the second upper surface 20*u*. As shown in FIG. 5, the second engagement elements 22 are a plurality of generally-hemispherical protrusions formed at positions such that they can engage with the first engagement elements 12 so as to upwardly protrude along the grooves of the first engagement elements 12.

The first engagement elements 12 and the second engagement elements 22 are formed integrally with the first deformable portion 11 and the second deformable portion 21, respectively.

As shown in FIGS. 3A and 3B, a first medial portion 13 being a portion on the foot medial side IN of the first deformable portion 11 in the first reinforcement member 10 is not attached to (vertically spaced apart from) a second medial portion 23 being a portion on the foot medial side IN of the second deformable portion 21 in the second reinforcement member 20. A first lateral portion 14 being a portion on the lateral side OUT of the first deformable portion 11 in the first reinforcement member 10 is not attached to (vertically spaced apart from) a second lateral portion 24 being a portion on the lateral side OUT of the second deformable portion 21 in the second reinforcement member 20. Therefore, a narrow space D2 running through from the foot medial side IN to the lateral side OUT is formed between the first reinforcement member 10 and the second reinforcement member 20.

The first medial portion 13 and the first lateral portion 14 of the first reinforcement member 10 are attached to the lower surface 2*d* of the mid sole 2.

In FIGS. 3A, 3B and 6A to 6C, the structure of the shoe sole of the present embodiment is drawn by exaggerating the distance between the first and second deformable portions 11 and 21 so as to better illustrate the structure (this similarly applies also to FIGS. 7A to 7D, 11A to 11C and 12A to 120). In practice, it may be more preferred that the first lower surface 12 and the second upper surface 22 are closer to each other than as shown in the figures.

Non-Worn State:

As shown in FIG. 6A, in the non-worn state where the shoe is not put on a foot, the first lower surface 10*d* of the first deformable portion 11 and the second upper surface 20*u* of the second deformable portion 21 are spaced apart from each other in the vertical direction. The first upper surface 10*u* of the first deformable portion 11 and the lower surface 2*d* of the mid sole 2 are spaced apart from each other in the vertical direction.

Figure 6B:
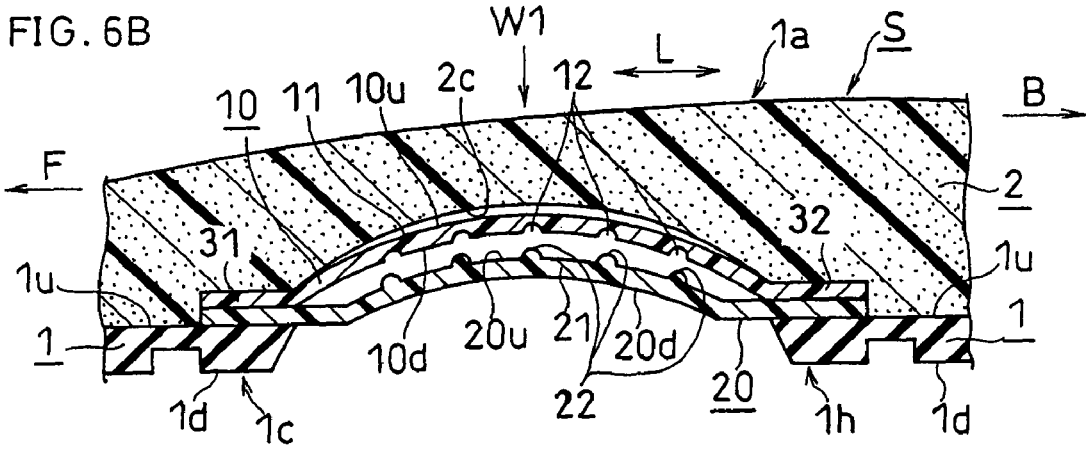

Under First Load:

When the body weight is applied to the shoe sole S after the shoe is put on a foot, a part of the body weight is applied to the mid sole, and the middle foot portion 1*a* of the mid sole 2 sinks downward, as shown in FIG. 6B. When a first load W1 is further applied to the shoe sole S by an impact of landing when walking or running, the arch portion 2*c* of the mid sole 2 comes into contact with the first upper surface 10*u* of the first deformable portion 11, and the first load W1 is applied to the first upper surface 10*u* of the first deformable portion 11. As the first deformable portion 11 is deflected downward by the first load W1 applied to the first upper surface 10*u*, the first lower surface 10*d* of the first deformable portion 11 comes closer to the second upper surface 20*u* of the second deformable portion 21. Then, as the first load W1 increases, the first lower surface 10*d* of the first deformable portion 11 is brought into contact with the second upper surface 20*u* of the second deformable portion 21 by the first load W1, as shown in FIG. 6C.

Figure 6C:
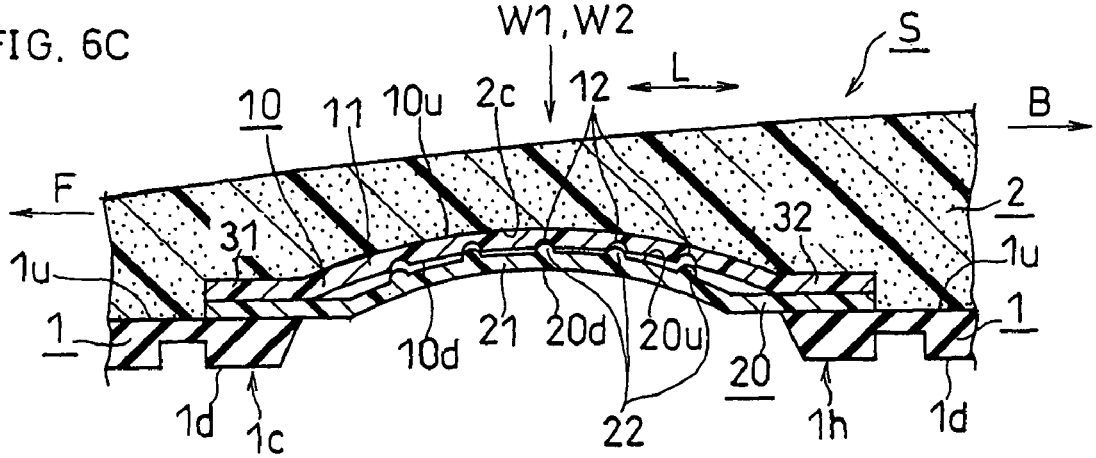
Figure 10A:
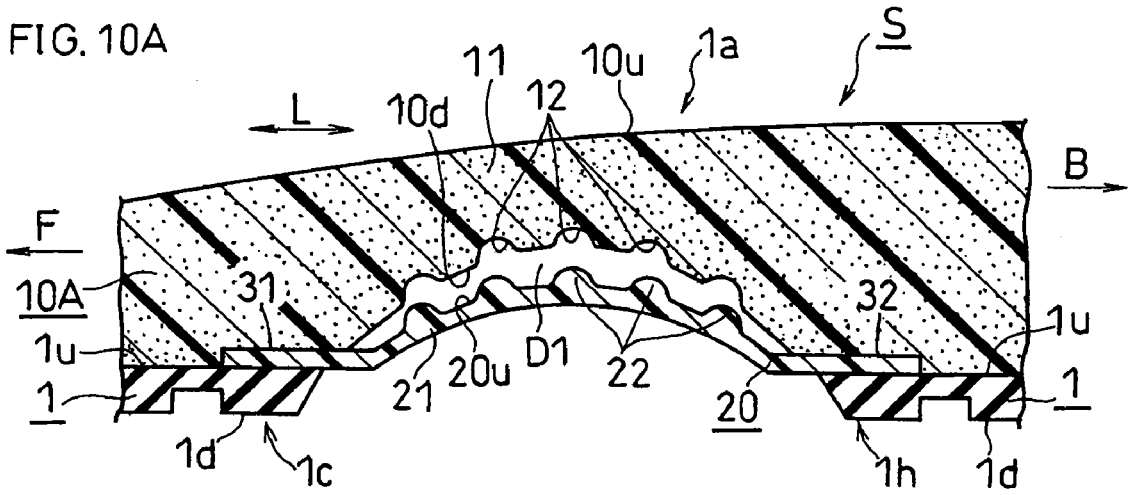
FIGS. 10A, 10B and 10C are partial vertical cross-sectional views showing engagement elements of the shoe sole and the vicinity thereof.
Figure 10B:
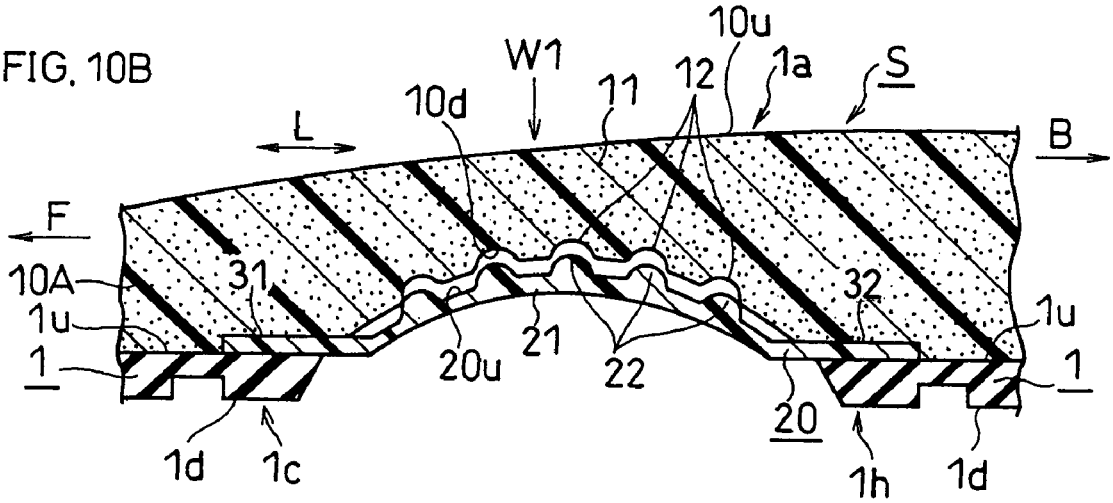
Figure 10C:
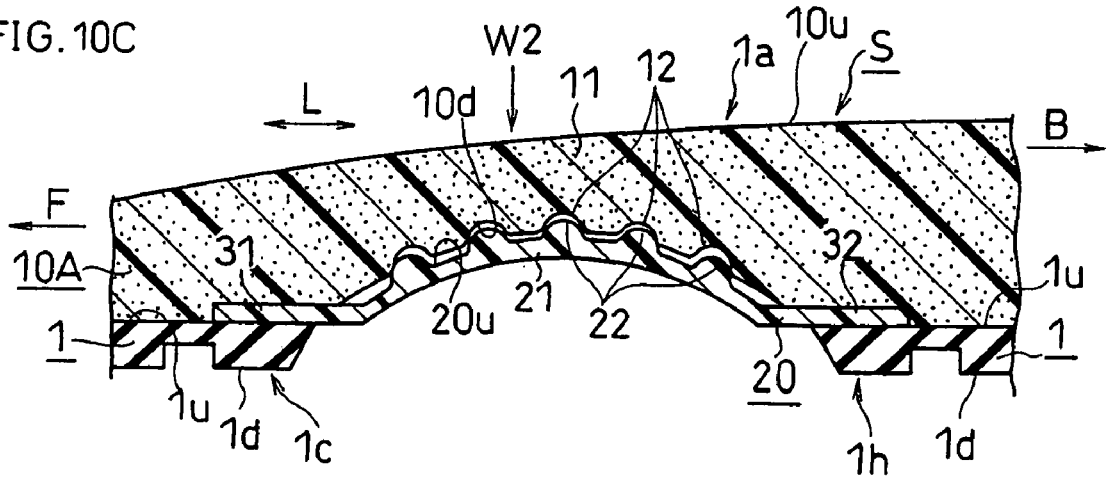
Figure 12A:
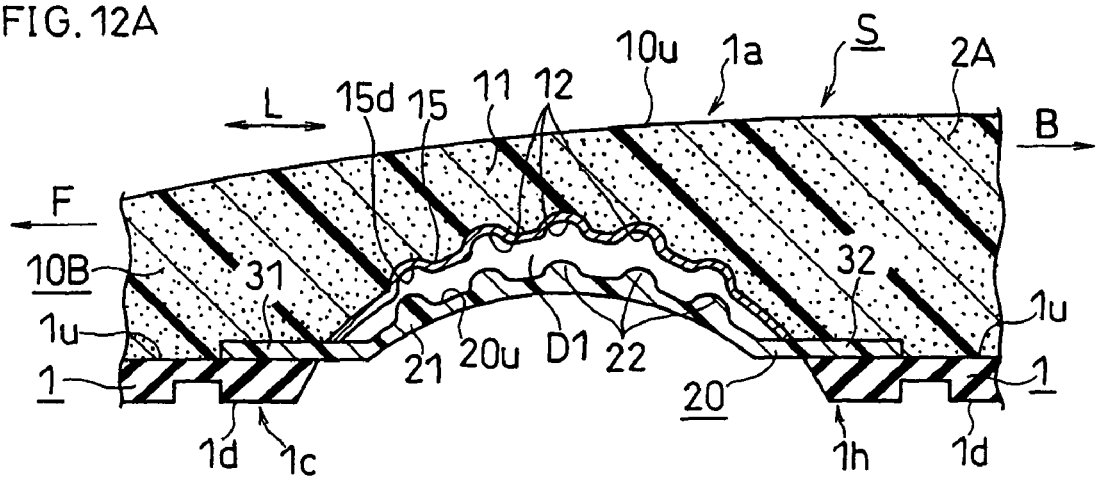
FIGS. 12A, 12B and 12C are partial vertical cross-sectional views showing a shoe sole according to a third embodiment.
Figure 12B:
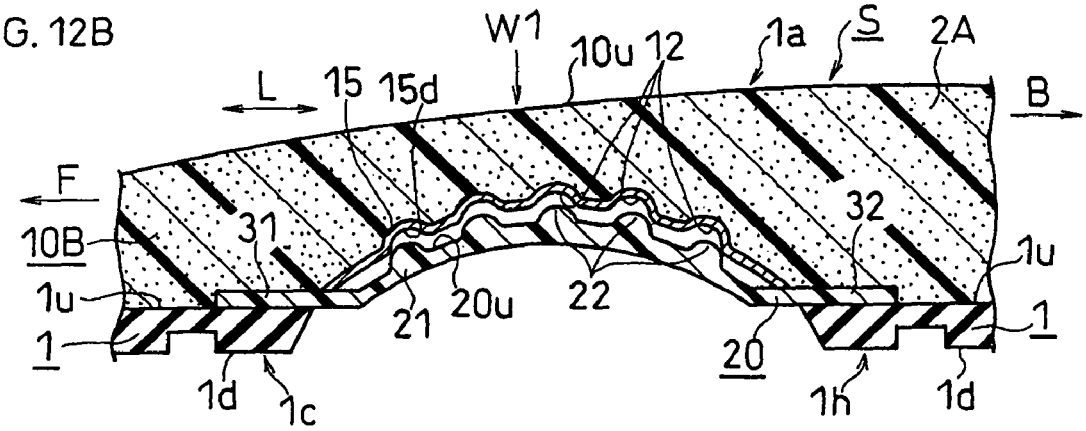
Figure 12C:
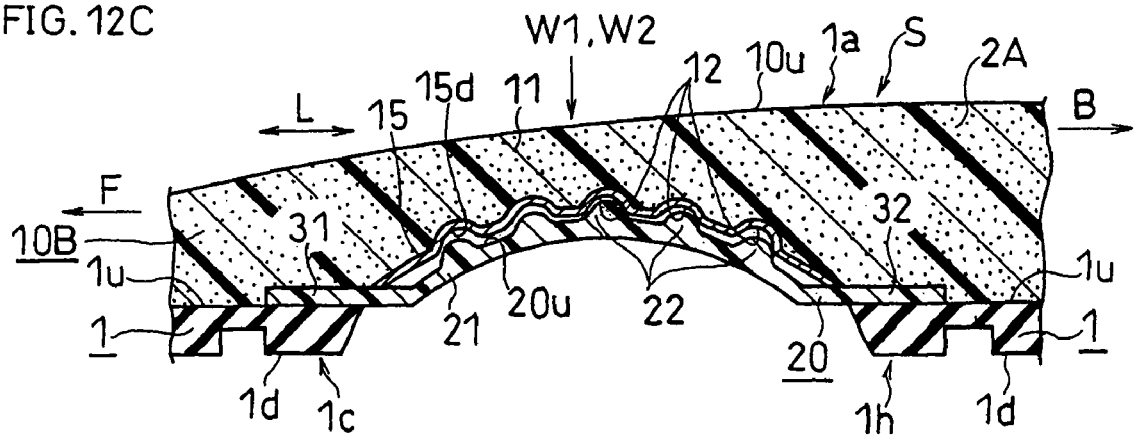

Although the first lower surface 10*d* and the second upper surface 20*u* are not drawn to be close enough to each other in FIGS. 6C, 10C and 12C, the space between the two surfaces 10*d* and 20*u* is smaller in practice.

Under Second Load:

When a second downward load W2 greater than the first load W1 is applied to the first upper surface 10*u* of the first deformable portion 11 as in a case where the arch of the foot is lowered by the impact upon landing, for example, the first engagement elements 12 and the second engagement elements 22 firmly engage with each other (a state where the engaging force is large), whereby the deformable portions 11 and 21 integrally deflect downward without substantially shifting from each other in the longitudinal direction L.

During Transitional Period:

In the transitional period between a period under the first load and a period under the second load, the first deformable portion 11 and the second deformable portion 21 further deflect downward while slightly shifting from each other in the longitudinal direction L, with the first lower surface 10*d* of the first deformable portion 11 and the second upper surface 20*u* of the second deformable portion 21 being in contact with each other, and with the engagement elements 12 and 22 lightly engaging with each other (a state where the engaging force is substantially smaller than that under the second load). The load during the transitional period (the predetermined load) is greater than the first load W1 and smaller than the second load W2.

As the load increases, the plurality of second engagement elements 22 firmly fit in the first engagement elements 12, and the engaging force with which the first engagement elements 12 and the second engagement elements 22 engage with each other in the longitudinal direction L increases, thus reaching the state under the second load.

The arrangement may be such that as the load applied to the first upper surface 10*u* increases, the engagement elements 12 and 22 more firmly engage with each other, thereby decreasing the distance between the first upper surface 10*u* of the first reinforcement member 10 and the second lower surface 20*d* of the second reinforcement member 20.

While the first deformable portion 11 and the second deformable portion 21 are provided with grooves and protrusions, respectively, as engagement elements in the first embodiment, the first deformable portion 11 and the second deformable portion 21 may be provided with protrusions and grooves, respectively.

Figure 7A:
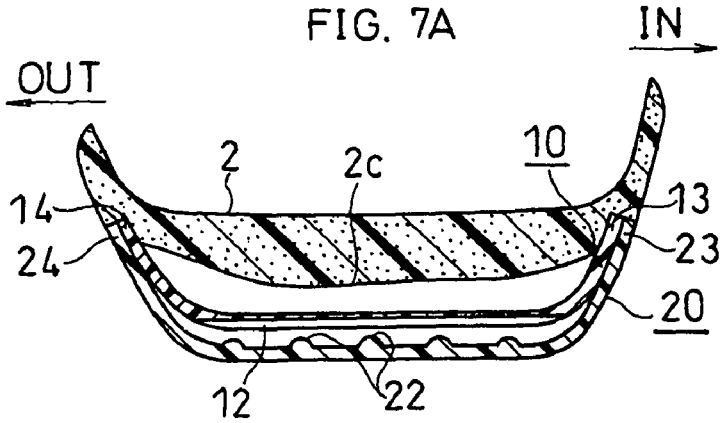
FIGS. 7A, 7B, 7C and 7D are horizontal cross-sectional views each showing a shoe sole of an alternative example.

As shown in FIG. 7A, the first medial portion 13 of the first reinforcement member 10 on the foot medial side IN and the second medial portion 23 of the second reinforcement member 20 on the foot medial side IN may be attached to each other, and the first lateral portion 14 of the first reinforcement member 10 on the foot lateral side OUT and the second lateral portion 24 of the second reinforcement member 20 on the foot lateral side OUT may be attached to each other. The attached portions may further be attached to the mid sole 2.

Figure 7B:
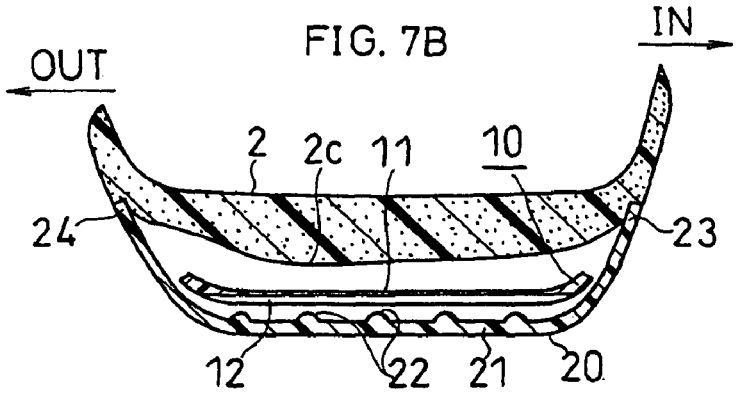
Figure 7C:
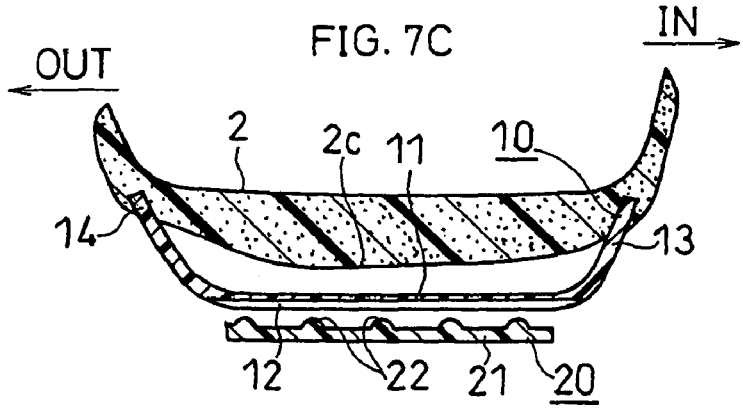

Only the second medial portion 23 of the second reinforcement member 20 on the foot medial side IN and the second lateral portion 24 thereof on the foot lateral side OUT may be attached to the mid sole 2, as shown in FIG. 7B.

Only the first medial portion 13 of the first reinforcement member 10 on the foot medial side IN and the first lateral portion 14 thereof on the foot lateral side OUT may be attached to the mid sole 2, as shown in FIG. 70.

Figure 7D:
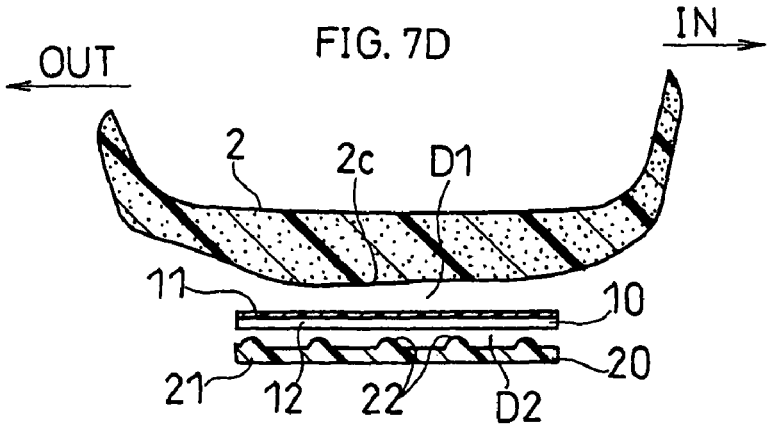

On the foot medial side IN and the lateral side OUT, neither of the first reinforcement member 10 and the second reinforcement member 20 may be attached to the mid sole 2, as shown in FIG. 7D. In such a case, a narrow space D1 running through from the foot medial side IN to the foot lateral side OUT is formed also between the mid sole 2 and the first reinforcement member 10, in addition to the space D2. Thus, with the first reinforcement member 10 attached, a cavity that is running continuously from the medial side IN to the lateral side of the foot is provided between the arch 2*c* of the mid sole 2 and the first reinforcement member 10 in the space D1 under the mid sole 2. Therefore, with the first reinforcement member 10 attached, there is formed an underpass extending from the medial side IN to the lateral side of the foot under the arch 2*c* of the mid sole 2. With such a structure, the mid sole 2 can deform and sink down in response to a downward load without being restricted by the first reinforcement member.

Figure 11A:
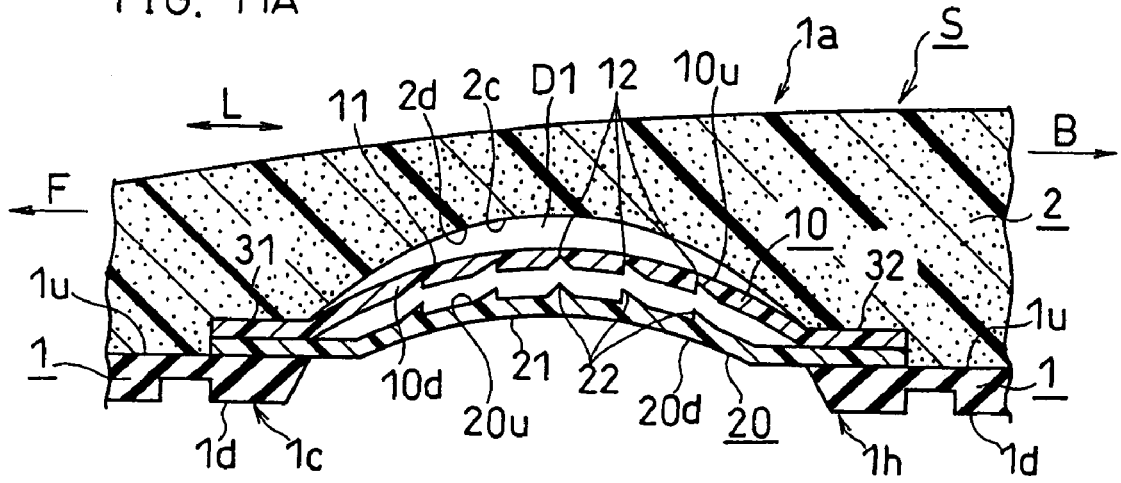
FIGS. 11A, 11B and 11C are partial vertical cross-sectional views each showing a shoe sole of an alternative example.

The second engagement elements 22 may be formed in a comb-shaped pattern, as shown in FIG. 11A.

Figure 11B:
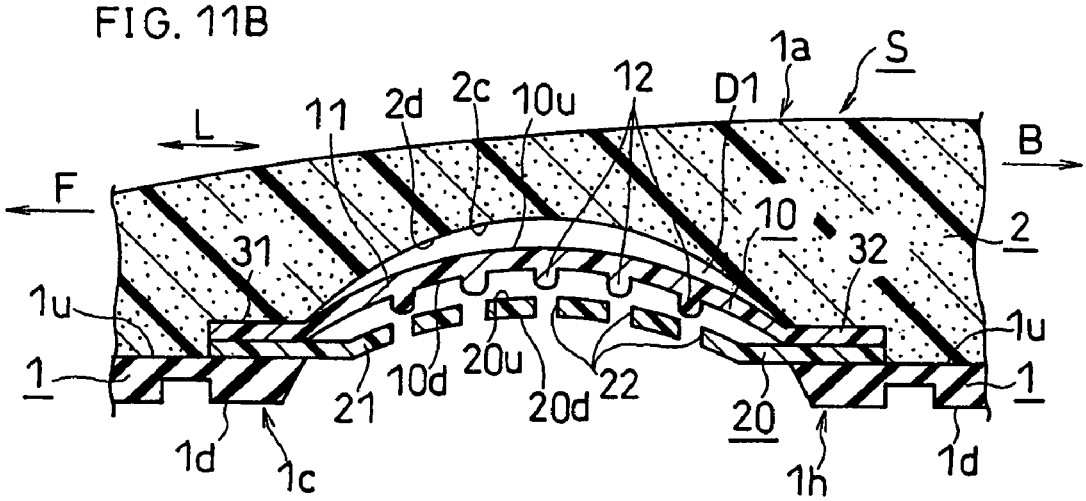

The second engagement elements 22 may be holes vertically running through the second deformable portion 21, as shown in FIG. 11B.

Figure 11C:
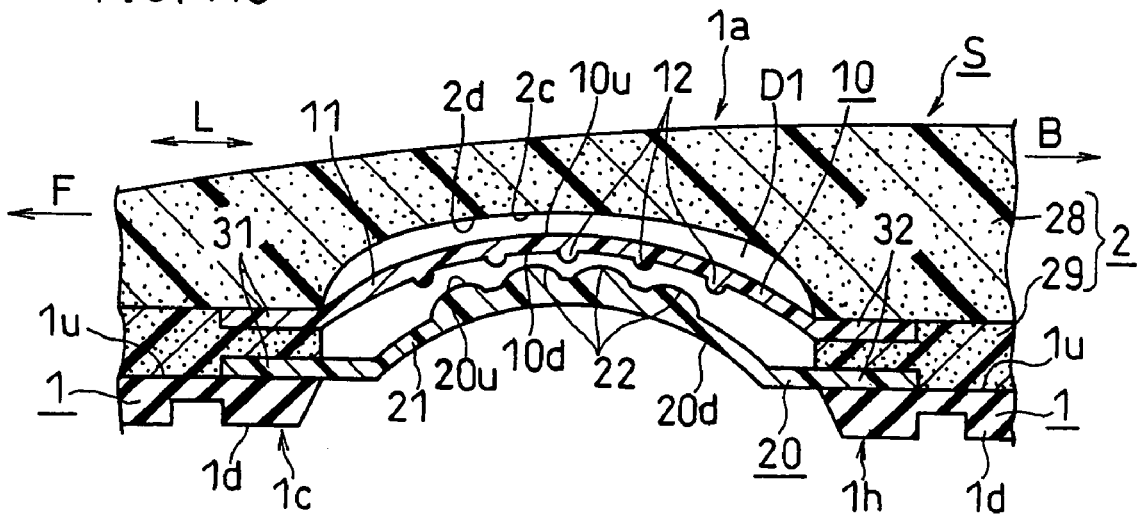

Generally-hemispherical engagement elements 12 and 22 may be formed on both the first deformable portion 11 and the second deformable portion 21, as shown in FIG. 11C. As such engagement elements 11 and 22 are engaged with each other, the first deformable portion 11 and the second deformable portion 21 are restricted from shifting from each other both in the longitudinal direction L and in the transverse direction W. In this example, the mid sole 2 is divided into an upper mid sole 28 and a lower mid sole 29, and the first reinforcement member 10 is sandwiched between the mid soles 28 and 29 at the rear end 1*c* of the front foot portion and at the front end 1*h* of the rear foot portion. Thus, the first and second attachment sections 31 and 32 of the reinforcement members 10 and 20 are attached to each other indirectly via the lower mid sole 29 therebetween.

Second Embodiment

A second embodiment of the present invention will now be described with reference to FIGS. 8A to 10C.

Figure 8A:
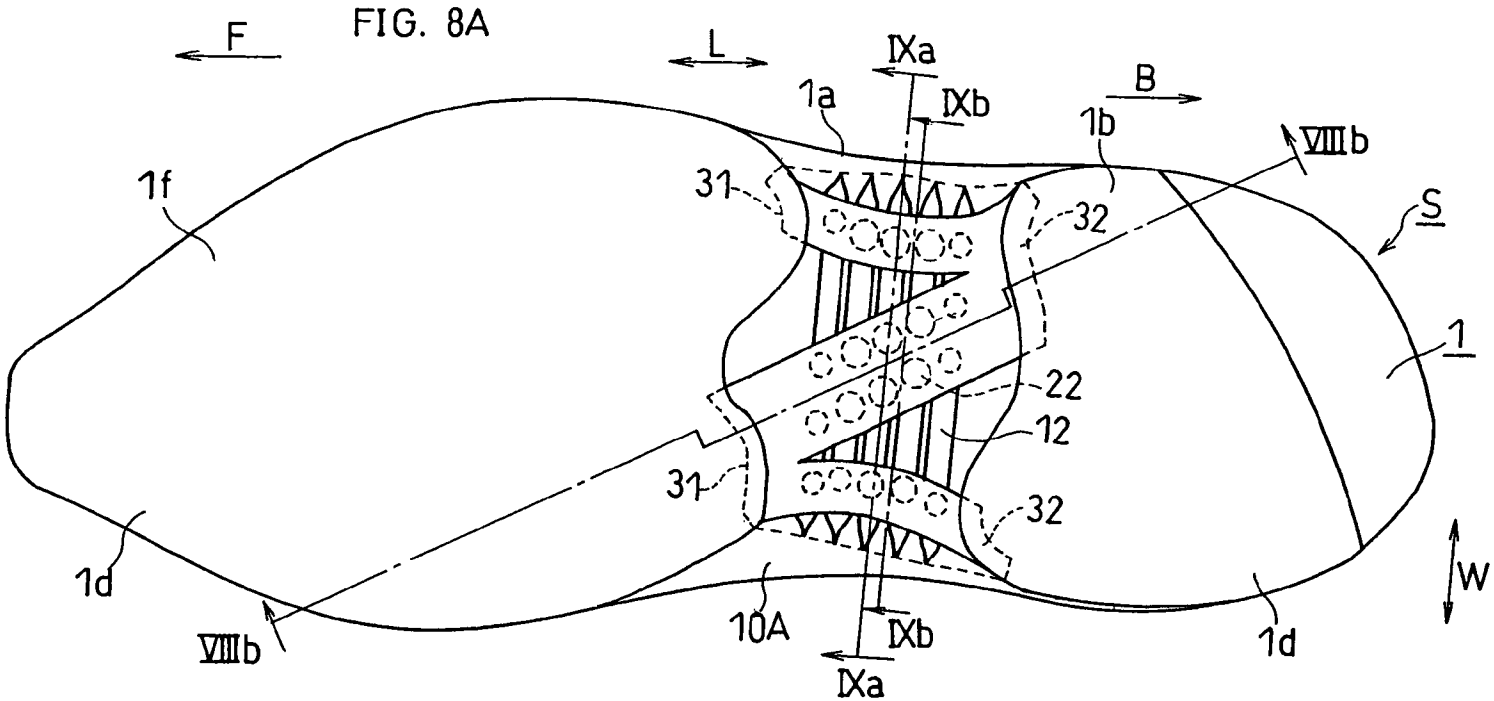
FIG. 8A is a bottom view showing a shoe sole according to a second embodiment of the present invention.
Figure 8B:
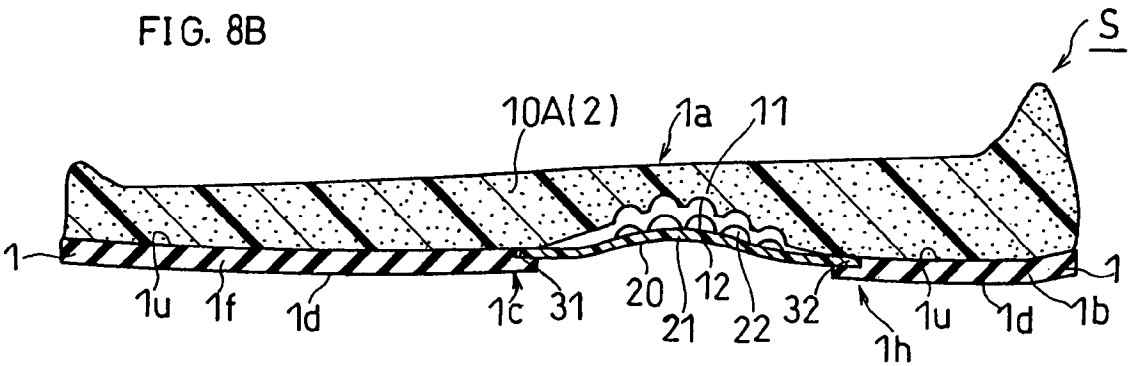
FIG. 8B is a cross-sectional view taken along line VIIIb-VIIIb in FIG. 8A.

As shown in FIG. 8B, the shoe sole of the present embodiment includes a shock absorbing layer (an example of the first member) 10A formed by using a foamed resin for absorbing the impact upon landing, i.e., the mid sole 2, the reinforcement member (an example of the second member) 20, and the outer sole 1. The first deformable portion 11 of the shock absorbing layer 10A includes the first engagement elements 12 being grooves extending in the transverse direction W, and the second deformable portion 21 of the reinforcement member 20 includes the second engagement elements 22 being hemispherical protrusions.

Figure 9B:
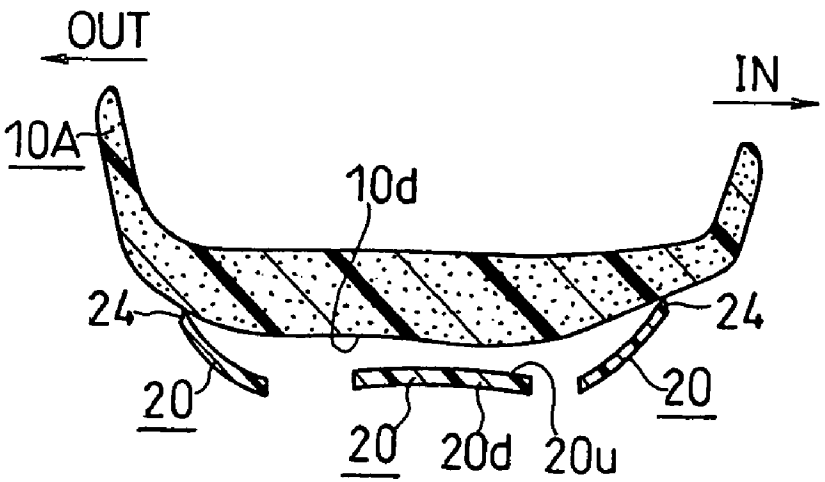
FIG. 9B is an end view taken along line IXb-IXb in FIG. 8A.
Figure 9A:
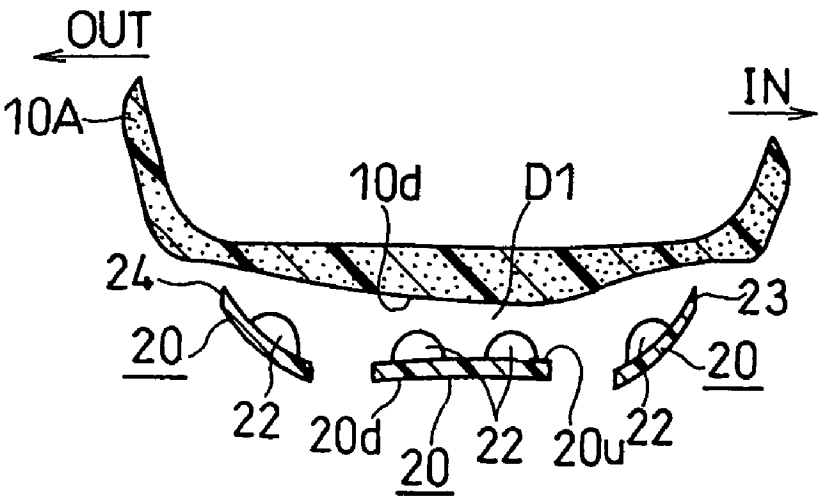
FIG. 9A is an end view taken along line IXa-IXa in FIG. 8A.

As shown in FIGS. 9A and 9B, the first lower surface 10*d* of the shock absorbing member 10A faces the second upper surface 20*u* of the reinforcement member 20. As shown in FIG. 9A, a portion of the second medial portion 23 of the reinforcement member 20 and a portion of the second lateral portion 24 are not attached to the shock absorbing layer 10A, and the space D1 running through from the medial side to the lateral side of the foot is formed in such portions between the first lower surface 10*d* and the second upper surface 20*u*.

As shown in FIG. 10A, the reinforcement member 20 is sandwiched between the shock absorbing layer 10A and the outer sole 1 in the first attachment section 31 at the rear end 1*c* of the front foot portion and at the front end 1*h* of the rear foot portion, thereby supporting the reinforcement member 20.

Otherwise, the structure is similar to that of the first embodiment described above, and like elements are denoted by like reference numerals and will not be further described or shown in the drawings.

Non-Worn State:

In the non-worn state shown in FIG. 10A, the first lower surface 10*d* of the first deformable portion 11 of the shock absorbing layer 10A and the second upper surface 20*u* of the second deformable portion 21 of the reinforcement member 20 are spaced apart from each other in the vertical direction.

Under First Load:

As shown in FIG. 10B, when the downward first load W1 smaller than a predetermined load is applied, the first deformable portion 11 is deflected downward by the first load W1, whereby the first lower surface 10*d* of the first deformable portion 11 comes closer to the second upper surface 20*u* of the second deformable portion 21, and then contacts the second upper surface 20*u* as shown in FIG. 10C.

Under Second Load:

When the arch of the foot is lowered by the impact upon landing, for example, the downward second load W2 greater than the predetermined load is applied to the first upper surface 10*u* of the first deformable portion 11. Thus, the first engagement elements 12 and the second engagement elements 22 firmly engage with each other, whereby the first lower surface 10*d* and the second upper surface 20*u* integrally deflect downward without shifting from each other in the longitudinal direction L.

In a case where the first lower surface 10*d* is formed only by a foamed resin, as in the present embodiment, it is preferred that the first engagement elements 12 are grooves and the second engagement elements are ridges so as to increase the area of engagement of the engagement elements and to thus increase the engaging force.

Third Embodiment

A third embodiment of the present invention will now be described with reference to FIGS. 12A to 12C.

As shown in FIG. 12A, a first member 10B includes a shock absorbing layer 2A formed by using a foamed resin, and a film or plate 15 of a non-foamed resin secured to the lower surface of the shock absorbing layer 2A. The second member 20 is formed by a second plate having a greater thickness than that of the film or plate 15.

Otherwise, the structure is similar to that of the second embodiment described above, and like elements are denoted by like reference numerals and will not be further described or shown in the drawings.

Non-Worn State:

In the non-worn state shown in FIG. 12A, a first lower surface 15*d* of the film 15 of the first member 10B is spaced apart from the second upper surface 20*u* of the second deformable portion 21 of the second member 20 in the vertical direction.

Under First Load:

As shown in FIGS. 12B and 12C, when the downward first load W1 smaller than a predetermined load is applied, the first deformable portion 11 deflects downward with the shock absorbing layer 2A and the film 15 being always integral with each other, whereby the first lower surface 15*d* of the film 15 comes closer to the second upper surface 20*u* of the second deformable portion 21, and then contacts the second upper surface 20*u*.

Under Second Load:

As shown in FIG. 12C, when the downward second load W2 greater than the predetermined load is applied to the first upper surface 10*u* of the first deformable portion 11, the first engagement elements 12 and the second engagement elements 22 firmly engage with each other, whereby the first lower surface 15*d* and the second upper surface 20*u* integrally deflect downward without shifting from each other in the longitudinal direction L.

Thus, as the first member 10B is formed by layering the film or plate 15 on the lower surface of the shock absorbing layer 2A of a foamed resin having a small Young's modulus, the engaging force between the engagement elements 12 and 22 is greater than that in the second embodiment where such a film or plate is absent.

Fourth Embodiment

A fourth embodiment of the present invention will now be described with reference to FIGS. 13 to 14C.

Figure 13:
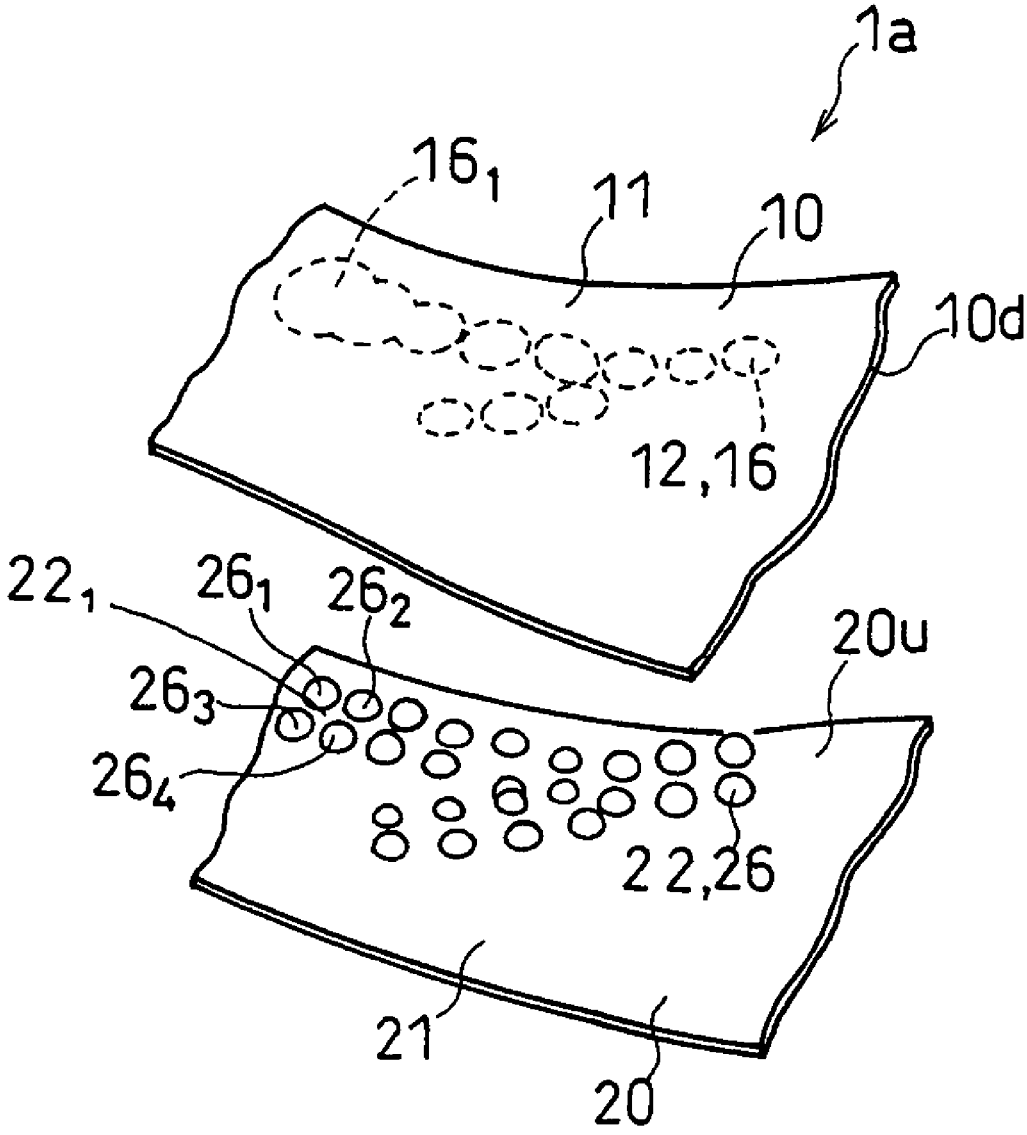
FIG. 13 is a partial exploded perspective view showing a middle foot portion of a reinforcement device according to a fourth embodiment.

As shown in FIG. 13, the shoe sole of the present embodiment includes plate-shaped first and second members 10 and 20 formed by using a non-foamed resin.

As shown in FIG. 13, the first and second members 10 and 20 are provided with a large number of first and second hemispherical protrusions 16 and 26, respectively. Some of the large number of protrusions 16 and 26 cooperate with each other and thus form the first or second engagement elements 11 or 22. For example, a first protrusion $\mathbf{16}_1$ of the first member 10 fits in a depression 221 surrounded by second protrusions $\mathbf{26}_1$ to $\mathbf{26}_4$ of the second member 20, thus enabling the engagement between the first member 10 and the second member 20. The engagement elements 12 and 22 may engage with each other not only in the longitudinal direction but also in the transverse direction.

The large number of protrusions 16 and 26 of the present embodiment may be formed to be smaller, and arranged more closely together, than those shown in FIG. 13. When employing such a structure that the contact area between the first and second protrusions 16 and 26 increases as they are more deformed, the protrusions 16 and 26 may be very small. In such a case, the first lower surface 10*d* and the second upper surface 20*u* may each be a rough surface such as a sandpaper-like surface. The size and shape of the protrusions of the engagement elements 12 and 22 may be non-uniform.

Figure 14A:
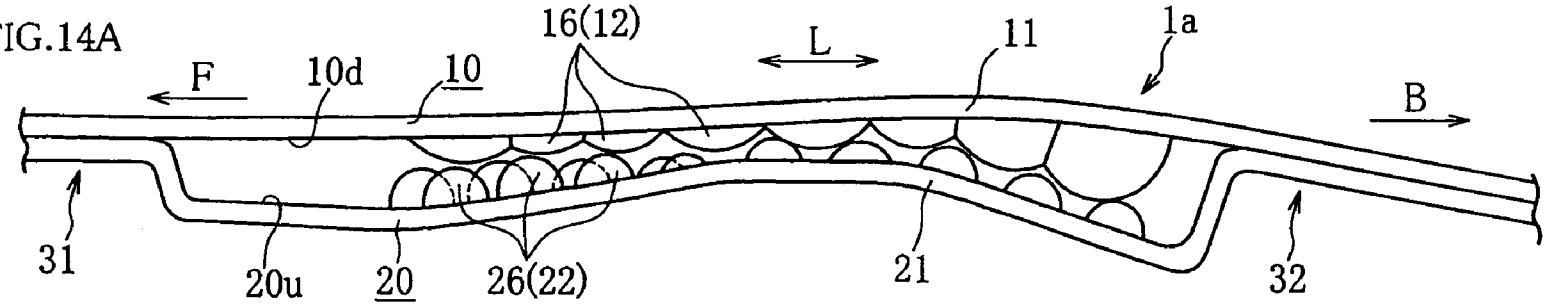
FIGS. 14A, 14B and 14C are partial side views showing engagement elements of the shoe sole and the vicinity thereof.

As shown in FIG. 14A, in the middle foot portion 1*a*, the distance between the first deformable portion 11 of the first member 10 and the second deformable portion 21 of the second member 20 is smallest at the central portion in the longitudinal direction L and largest at the rear end in the longitudinal direction L. The protruding heights of the hemispherical protrusions 16 and 26 of the engagement elements are determined according to the distance between the first deformable portion 11 and the second deformable portion 21. Therefore, in the non-worn state of FIG. 14A, the large number of protrusions 16 and 26 are close to each other at a generally uniform distance in the vertical direction.

Figure 14B:
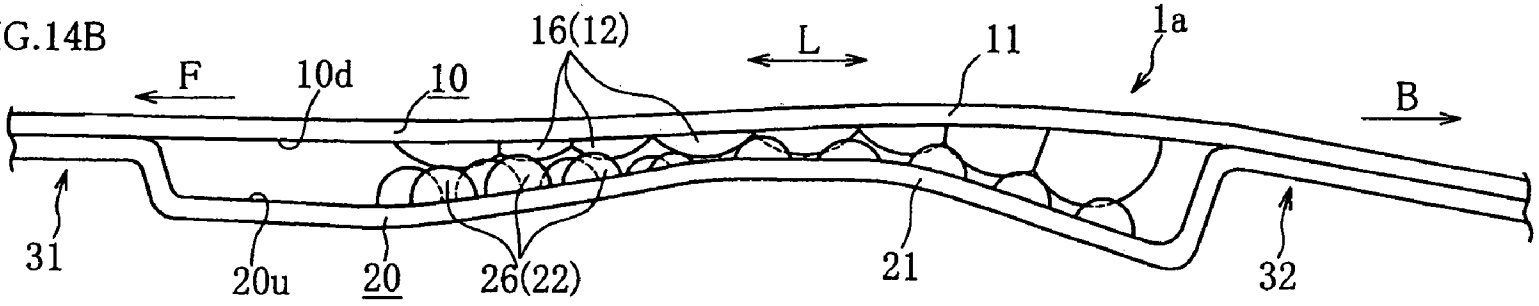
Figure 14C:
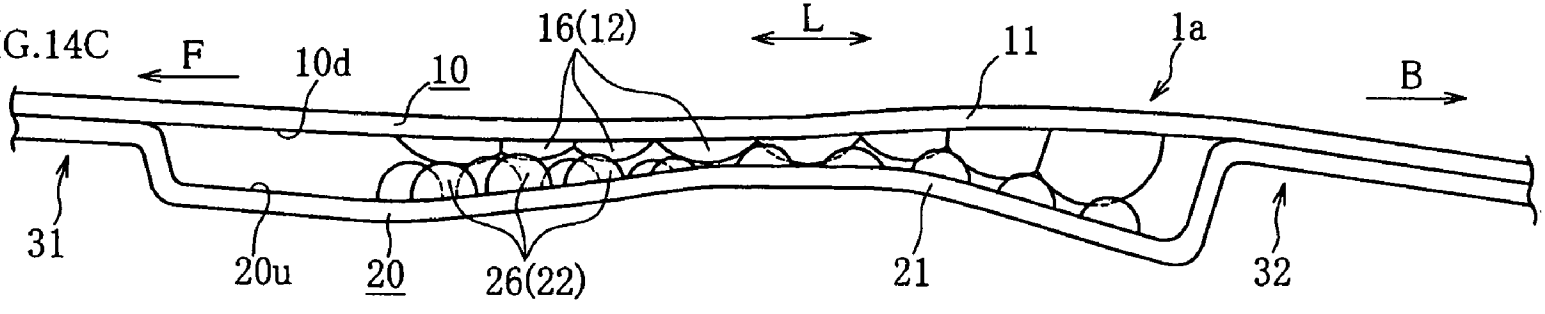

Under the body weight of the wearer or when the wearer is walking or jogging, i.e., in the worn state of FIG. 14B where the first load W1 is applied to the upper surface 10*u* of the first deformable portion 11, substantially only the first member 10 slightly deflects downward (the second member 20 does not substantially deflect), and the lower surface 10*d* of the first deformable portion 11 (the top surface of the first protrusion 16) comes closer to the upper surface 20*u* of the second deformable portion 21. When the first load W1 increases, a portion of the large number of first protrusion 16 of the first member 10 contacts a portion of the large number of second protrusions 26 of the second member 20 near a position generally at the center in the longitudinal direction L.

After the protrusions 16 and 26 come into contact with each other, as the load applied to the first upper surface 10*u* increases, the deflection of the first and second members 10 and 20 increases, thus increasing the depth of engagement between the protrusions 16 and 26 and the area of contact between the protrusions 16 and 26. Then, when the first upper surface 10*u* and the second upper surface 20*u* are not substantially shifted from each other due to the engaging force between the members 10 and 20, the members 10 and 20 start to deflect integrally as if they were a combined beam in such a non-shifting portion, and the flexural rigidity substantially increases at this point. Therefore, the amount of deflection with respect to the increase in the load becomes small, thereby enhancing the function of protecting foot joints, or the like, from excessive forces.

Fifth Embodiment

A fifth embodiment of the present invention will now be described with reference to FIGS. 16 to 18. The fifth embodiment will be described below primarily for its differences from the first embodiment.

Figure 16:
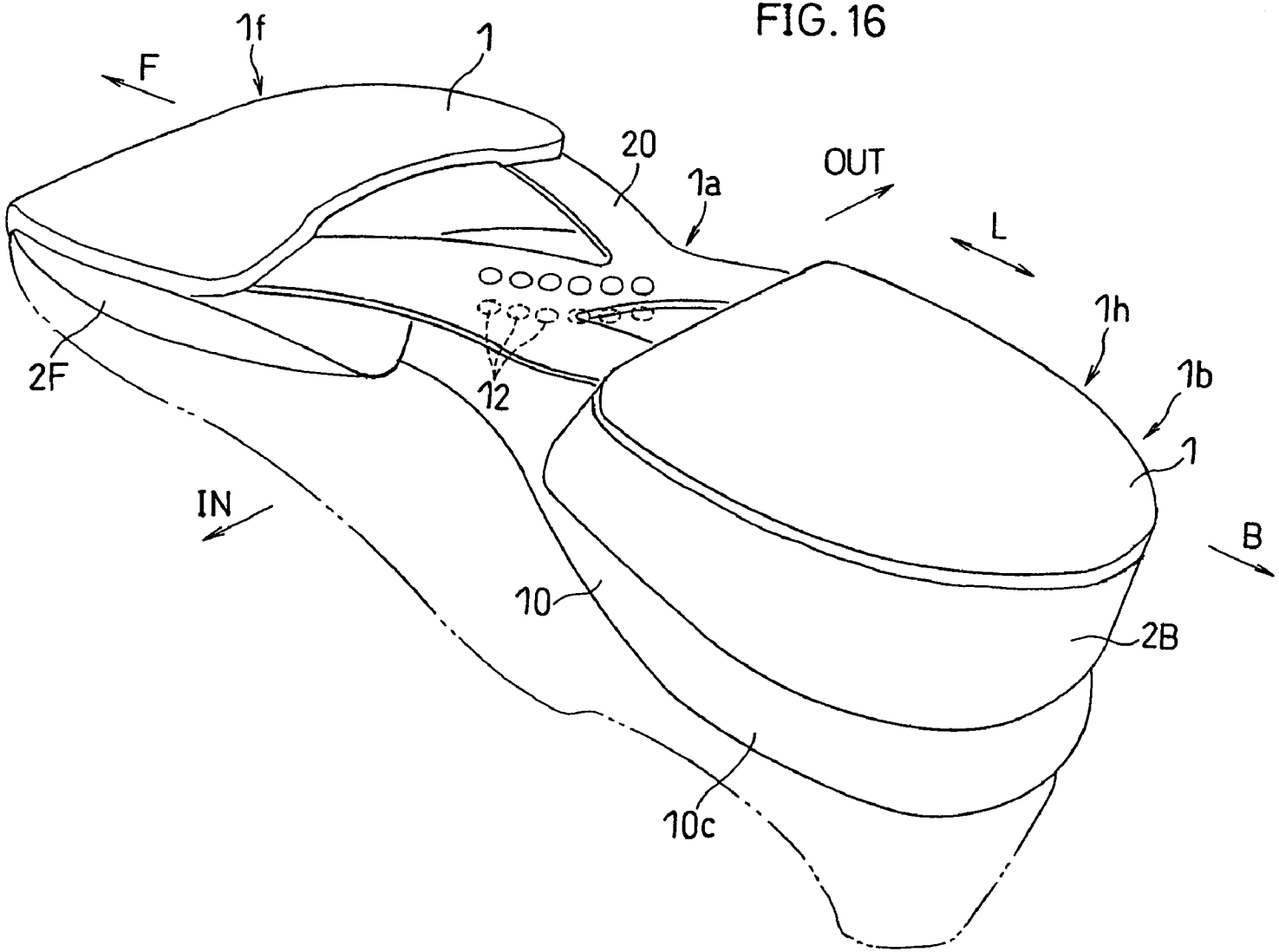
FIG. 16 is a perspective view showing a shoe with a reinforcement structure according to a fifth embodiment, as viewed from the bottom surface side.
Figure 17A:
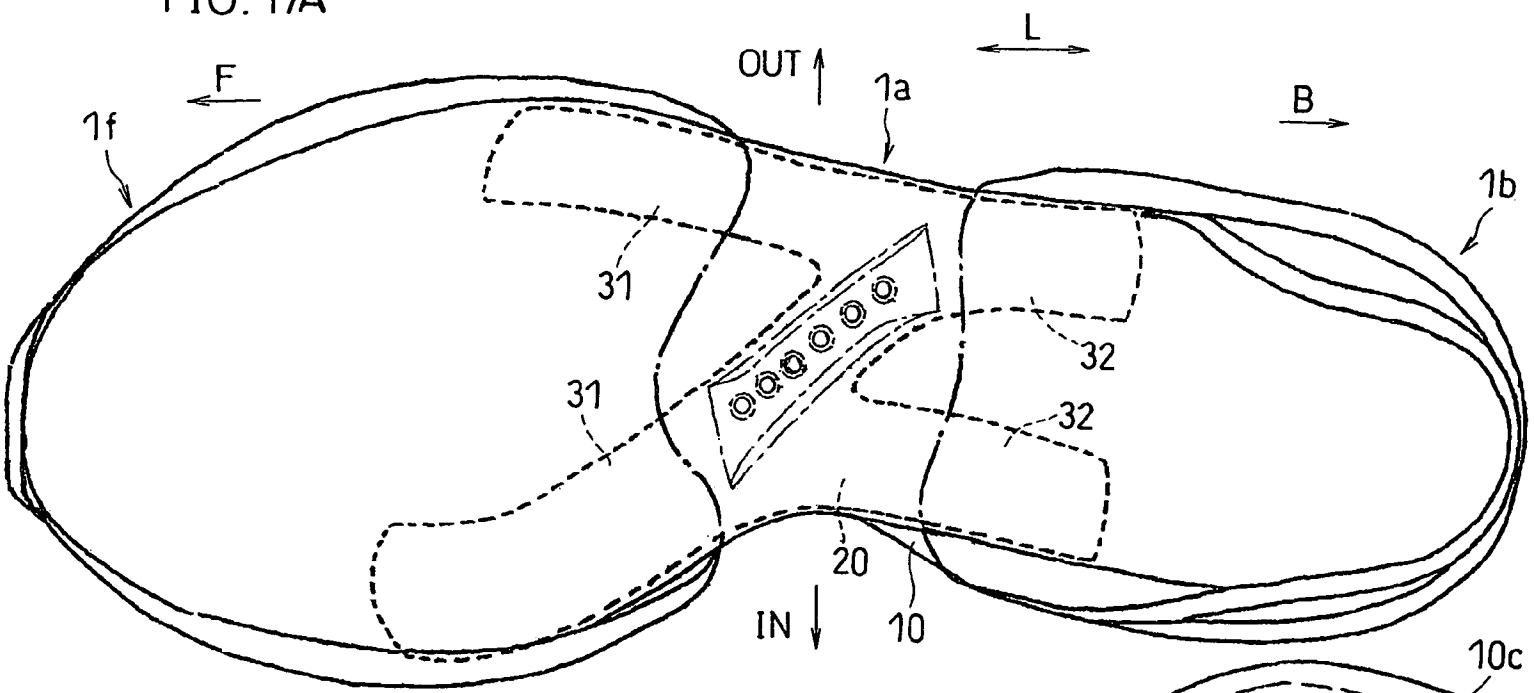
FIG. 17A is a plan view of a shoe sole of the shoe.
Figure 17B:
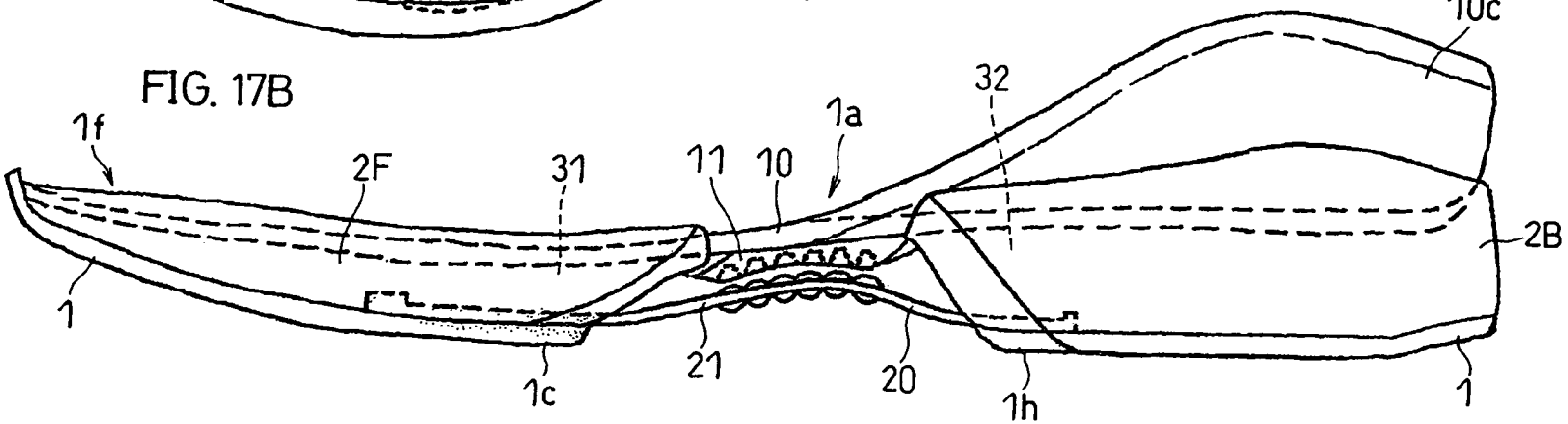
FIG. 17B is a side view showing the shoe sole.
Figure 18:
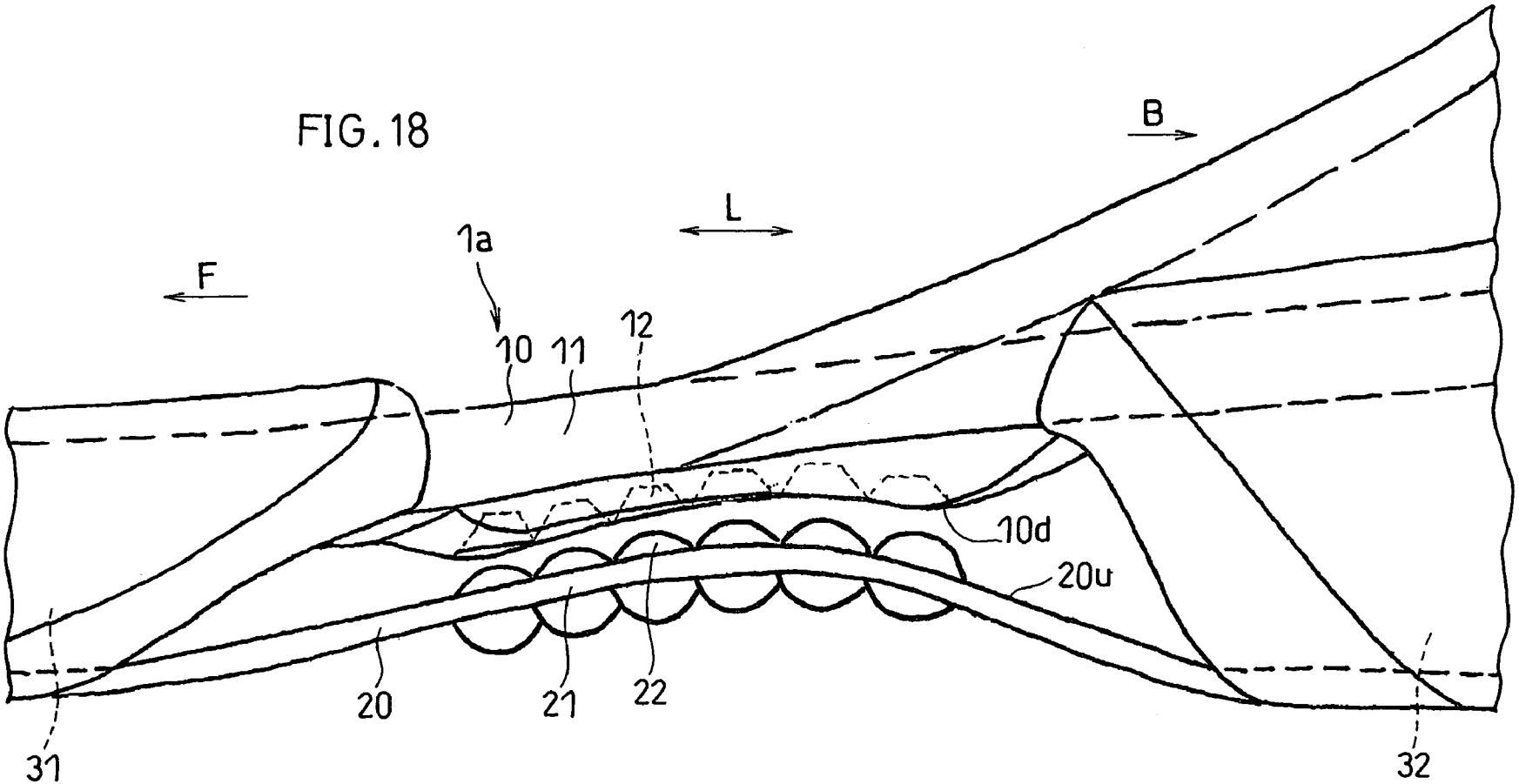
FIG. 18 is a partial enlarged side view showing a middle foot portion of the shoe sole.

FIGS. 16 to 18 show a shoe sole, etc., in the non-worn state.

In this embodiment, the first member 10 is a cup sole that is continuous from the front foot portion 1*f* to the rear foot portion 1*h*. The cup sole is formed by using a non-foamed resin, and includes a rolled-up portion 10*c* that is rolled up along the heel of the foot. An insole is layered on the upper surface of the first member 10.

Separate front and rear mid soles 2F and 2B are secured to the front foot portion 1*f* and the rear foot portion 1*h* of the first member 10. The first lower surface 10*d* of the first deformable portion 11 of the first member 10 is exposed between the front and rear mid soles 2F and 2B (FIG. 18).

The second member 20 is secured while being sandwiched between the lower surfaces of the front and rear mid soles 2F and 2B and the outer sole 1.

Thus, the first member 10 and the second member 20 are attached to each other via the mid soles 2F and 2B therebetween in the first attachment section 31 and in the second attachment section 32.

In FIG. 18, the second member 20 is exposed in the middle foot portion 1*a*.

The first lower surface 10*d* of the first member 10 and the second upper surface 20*u* of the second member 20 are closely facing each other, but are slightly spaced apart from each other, in the middle foot portion 1*a*.

The first engagement elements 12 being a plurality of depressed portions, for example, are formed on the first lower surface 10*d* of the first member 10. The second engagement elements 22 being a plurality of protrusions, for example, are formed on the second upper surface 20*u* of the second member 20. As shown in FIGS. 17A and 18, the first engagement elements 12 and the second engagement elements 22 are placed facing each other.

The engagement elements 12 and 22, being spaced apart from each other in the non-worn state of FIG. 18, fit to each other when the second load is applied to the first upper surface 10*u* of the first deformable portion 11 by the impact upon landing, and the deformable portions 11 and 21 integrally deflect downward without substantially shifting from each other in the longitudinal direction L.

In this embodiment, no mid sole is provided in the middle foot portion 1*a*, whereby it is possible to reduce the weight of the shoe sole.

Otherwise, the structure of the present embodiment is similar to that of the embodiment shown in FIGS. 2A to 5 or that of the embodiment shown in FIGS. 13 to 14C, and like elements are denoted by like reference numerals and will not be further described below.

Sixth Embodiment

A sixth embodiment of the present invention will now be described with reference to FIGS. 19A and 19B.

Figure 19A:
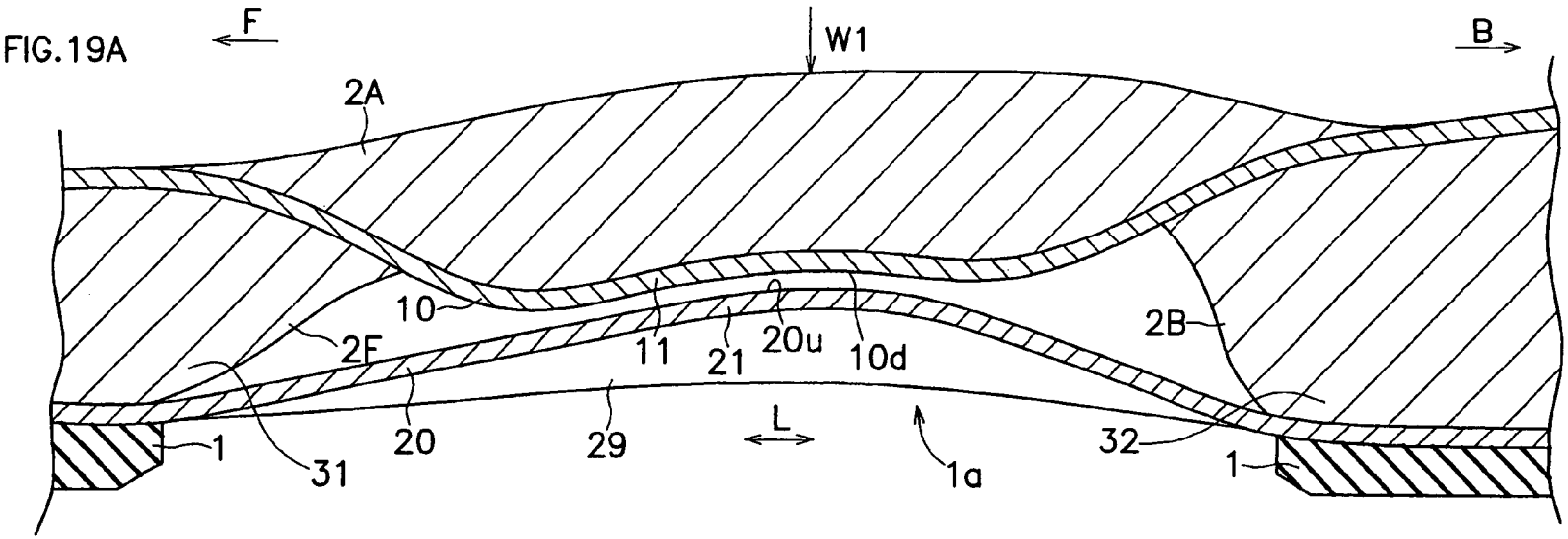
FIG. 19A is a partial vertical cross-sectional view showing a reinforcement device according to a sixth embodiment.
Figure 19B:
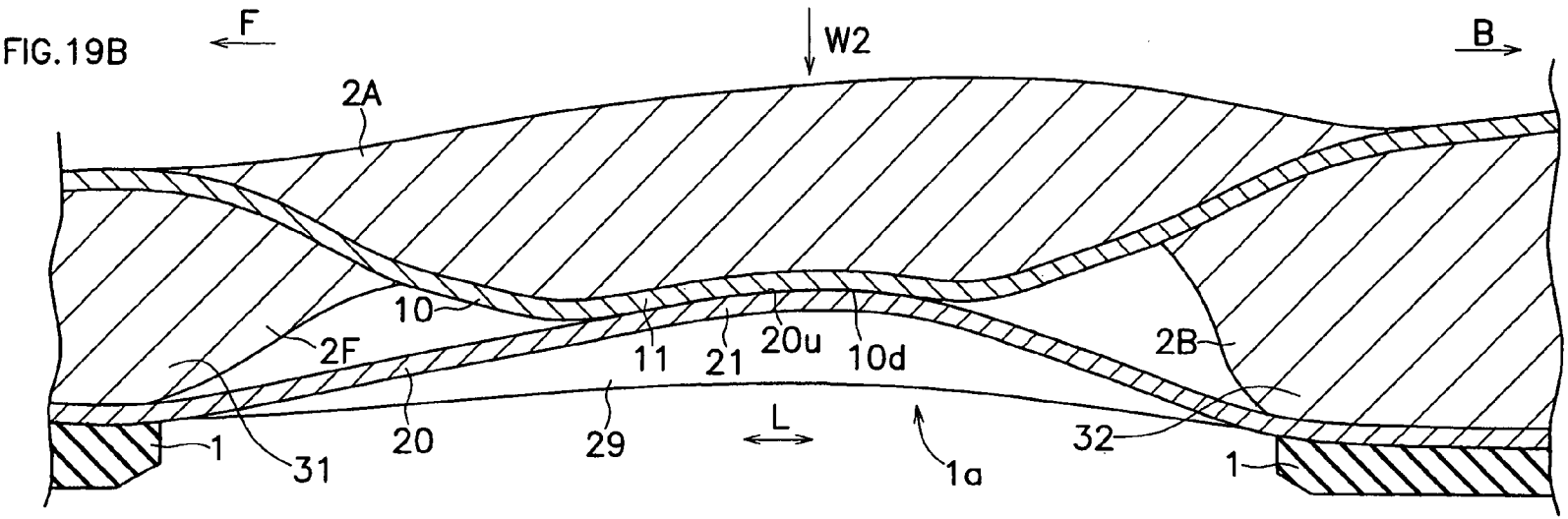
FIG. 19B is a partial vertical cross-sectional view showing the reinforcement device being in the form of a layered beam.

No engagement elements are provided in the embodiment shown in FIGS. 19A and 19B. The shock absorbing layer 2A is placed on the upper surface of the middle foot portion 1*a* of the first member 10, and the upper surface of the shock absorbing layer 2A fits to the arch of the sole of the foot. The hardness of the shock absorbing layer 2A may be set to be smaller than or greater than that of the other mid soles 2F and 2B.

An auxiliary rib 29 extending in the longitudinal direction L is formed integrally with the second member 20 under the first member 10. With the auxiliary rib 29, the second deformable portion 21 has a structure with a high flexural rigidity that does not easily deflect.

In the non-worn state of FIG. 19A, the first lower surface 10*d* of the first deformable portion 11 and the second upper surface 20*u* of the second deformable portion 21 are spaced apart from each other.

When the shoe is put on a foot, and the first load W1 is applied to the shock absorbing layer 2A of FIG. 19A, the first lower surface 10*d* of the first deformable portion 11 is slightly displaced downward and comes closer to the second upper surface 20*u* of the second deformable portion 21.

When the arch of the foot lowered by the impact upon landing and the second load W2 of FIG. 19B greater than the first load W1 is applied to the shock absorbing layer 2A, the shock absorbing layer 2A is compressed and deformed while the first lower surface 10*d* of the first deformable portion 11 deflects downward to contact the second upper surface 20*u* of the second deformable portion 21. Where the load W2 is large, the first deformable portion 11 deflects downward, and the second deformable portion 21 also deflects. Thus, the two deformable portions 11 and 21 serve as a layered beam as shown in (a) and (b) of FIG. 1. Therefore, it is possible to prevent the arch of the foot from lowering significantly.

Next, an advantage of a shoe sole having such a layered beam structure will be discussed in detail.

Figure 15A:
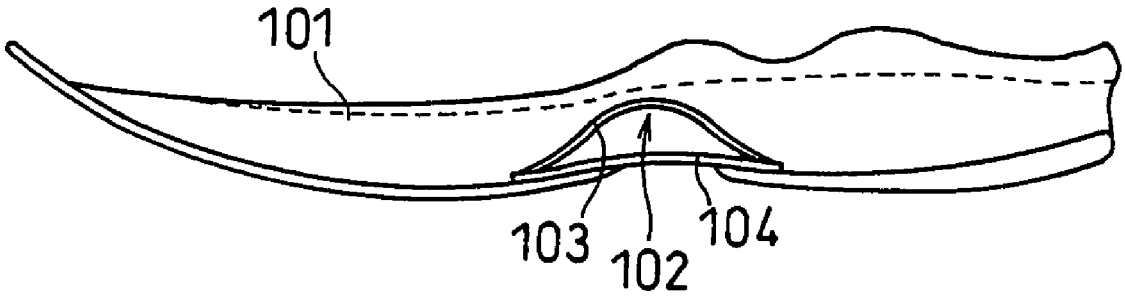
FIG.15 A PRIOR ART
FIG. 15A is a side view showing a conventional example.
Figure 15B:
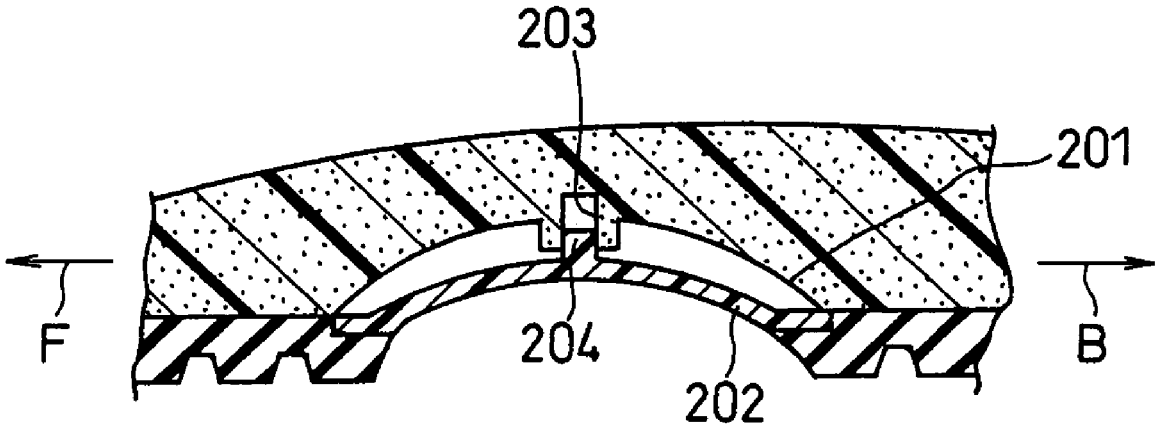
FIG.15 B PRIOR ART
FIG. 15B is a cross-sectional view showing another conventional example.

Even with the conventional structure of FIG. 15B, it may be possible to suppress the excessive lowering of the arch of the foot while reducing the upthrusting feel.

With the conventional structure, however, the first arch 201 supporting the arch of the foot significantly deflects toward the second arch 202 below. Therefore, there may be lowering of the arch of the foot corresponding to the space between the arches 201 and 202. Thus, it is possible to suppress the lowering of the arch of the foot by narrowing the space between the two arches 201 and 202. Specifically, under an excessive load (under the second load), the two deformable portions 11 and 21 serve as a layered beam shown in FIG. 19B to support the load W2, whereby it is possible to suppress the lowering of the arch of the foot.

Under the first load W1, the upthrusting feel will be reduced by, for example, forming the shock absorbing layer 2A by using a foam that is softer than the mid soles 2B and 2C.

Next, the ease of running with shoes having the layered beam structure and their function of stably protecting the feet will be described.

It is already known in the art that the ease of running of shoes can be evaluated in terms of the rigidity of the middle foot portion 1*a*. It is generally said that the ease of running improves as the rigidity of the middle foot portion is increased as long as it is within a certain range.

In order to evaluate the ease of running of the shoes of the present embodiment, the natural frequency and the rigidity of the sole portion were calculated by a computer simulation for an always-hollow structure (i) as shown in FIG. 15B in which the first arch 201 and the second, arch 202 do not contact with each other, and a layered beam structure (ii) as shown in FIG. 19B in which they contact with each other under the second load.

The results of calculation indicated that the layered beam structure (ii) has a greater natural frequency, hence a greater rigidity, than that of the hollow structure (i). Also based on the simulation results, it is presumed that it is possible to produce shoes with a high level of ease of running by employing the layered beam structure (ii).

Seventh Embodiment

FIGS. 20A to 20D each show an alternative structure capable of exerting the advantage of the layered beam. The structures will now be described.

Figure 20A:
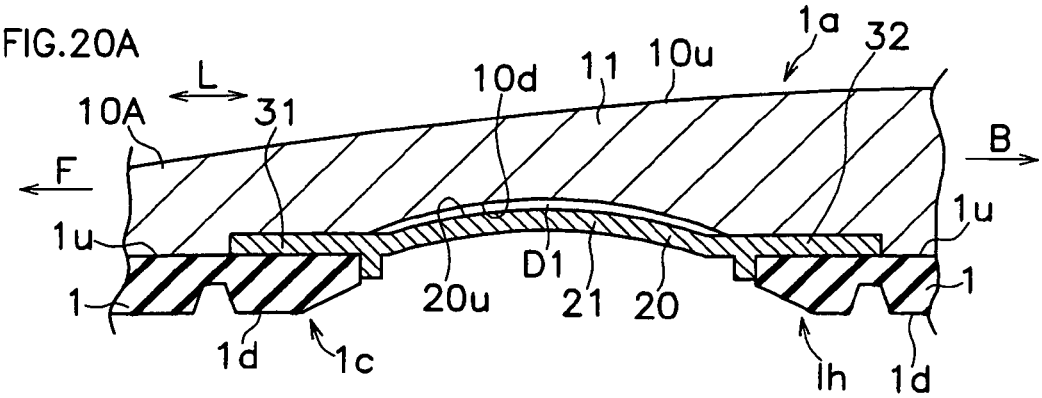
FIGS. 20A, 20B, 20C and 20D are partial vertical cross-sectional views each showing a middle foot portion of a shoe sole having an alternative reinforcement structure.

In the seventh embodiment of FIG. 20A, the first deformable portion 11 is formed by a foamed resin.

Figure 20B:
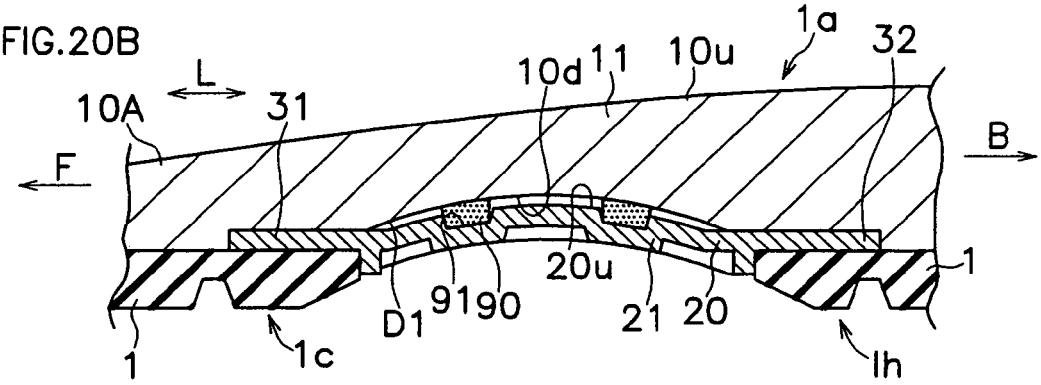
Figure 20C:
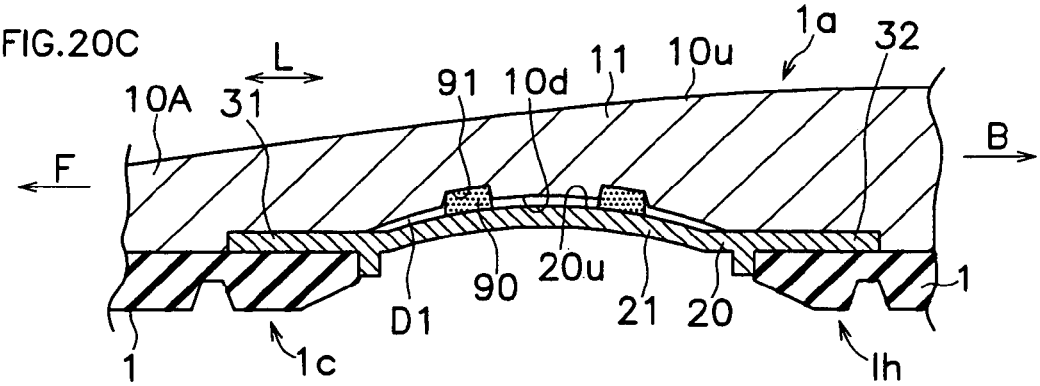

In alternative examples shown in FIGS. 20B and 20C, a foamed resin 90 capable of being compressibly deformed and having a smaller Young's modulus than that of the first deformable portion 11 is inserted between the first deformable portion 11 and the second deformable portion 21. In this case, a groove 91 in which the foam 90 can fit may be formed in the deformable portion 11 or 21.

Figure 20D:
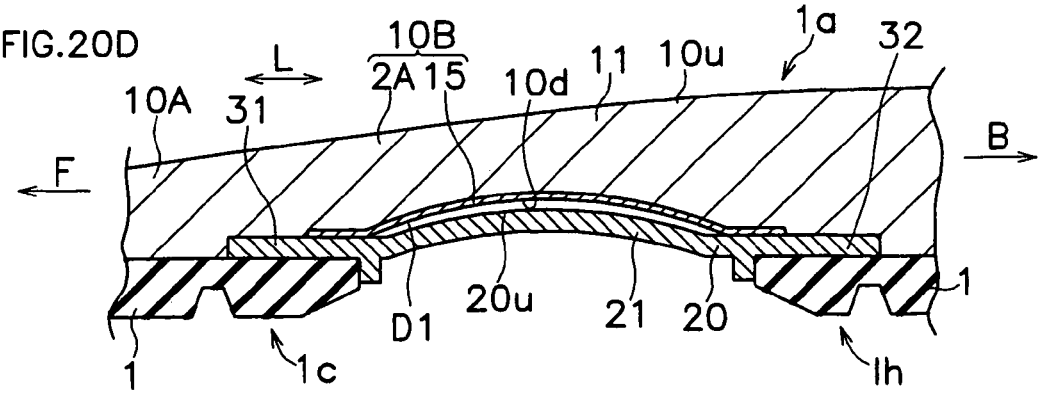

In another alternative example shown in FIG. 20D, the shock absorbing layer 2A and the film or plate 15 together form the first member 10B.

Otherwise, the structure of the present embodiment is similar to those of the embodiments above.

Also in the present embodiment, the space D1 may be running through in the transverse direction, or may be a substantially sealed space. Since the upper and lower shanks are unlikely to contact with each other under an air pressure if the space is completely sealed, the second deformable member 20 or the mid sole may be provided with small holes for ventilation running through in the vertical direction.

While preferred embodiments have been described above with reference to the drawings, various obvious changes and modifications will readily occur to those skilled in the art upon reading the present specification.

For example, in a case where the first and second members are reinforcement members, the shape thereof as seen in a plan view is not limited to an N-letter shape, but may be any of various other shapes such as an X-letter shape, a Y-letter shape, an H-letter shape and a square shape.

Such changes and modifications shall be deemed to fall within the scope of the present invention.

INDUSTRIAL APPLICABILITY

The present invention can be applied not only to athletic shoes such as running shoes, but also to various other kinds of shoes.

The invention claimed is:

1. A method of protecting a person's arch of a foot comprising:

providing a shoe sole having a front foot portion, a middle foot portion and a rear foot portion, comprising:

a first member covering at least a portion of an arch of a foot; and a second member placed under the first member, wherein:

the first member and the second member are attached to each other in a first attachment section at a rear end of the front foot portion;

the first member and the second member are attached to each other in a second attachment section at a front end of the rear foot portion;

the first member includes a first deformable portion capable of bending deformation, formed between the first attachment section and the second attachment section;

the second member includes a second deformable portion capable of bending deformation, formed between the first attachment section and the second attachment section;

the first deformable portion includes a first upper surface and a first lower surface;

the second deformable portion includes a second upper surface and a second lower surface;

the first lower surface is facing the second upper surface;

the first lower surface and the second upper surface are substantially spaced apart from each other in a vertical direction and not cooperatively in contact with each other;

placing the foot of the person on the first upper surface to apply a load downwardly to the first upper surface, whereby the first deformable portion deflects downwardly until the first lower surface contacts the second upper surface and a portion of the first lower surface and a portion of the second upper surface cooperatively contact each other to deflect downward and a portion of the load applied to the first upper surface is applied to the second upper surface.

2. The method of claim 1, wherein:

the first deformable portion includes a first medial portion located on a medial side of the foot and a first lateral portion located on a lateral side of the foot;

the second deformable portion includes a second medial portion located on the medial side of the foot and a second lateral portion located on the lateral side of the foot; and before placing the foot of the person on the first upper surface to apply a load downwardly to the first upper surface, the first medial portion and the second medial portion are substantially spaced apart from each other in a vertical direction and not cooperatively in contact with each other, and the first lateral portion and the second lateral portion are substantially spaced apart from each other in a vertical direction and not cooperatively in contact with each other.

3. The method of claim 2, wherein before placing the foot of the person on the first upper surface to apply a load downwardly to the first upper surface, a space running through from the medial side to the lateral side of the foot is formed between the first deformable portion and the second deformable portion.

4. The method of claim 1, wherein a Young's modulus of the first member is smaller than that of the second member.

5. The method of claim 1, wherein:

the first member includes a shock absorbing layer of a foamed resin for absorbing an impact upon landing; and the second member includes a plate of a non-foamed resin.

6. The method of claim 1, wherein the first lower surface does not contact the second upper surface until the load is greater than 25 kg to 35 kg.

* * * * *